US009183703B2

(12) United States Patent
Yoshizawa

(10) Patent No.: US 9,183,703 B2
(45) Date of Patent: Nov. 10, 2015

(54) GAMING SYSTEM IN WHICH A PLURALITY OF SLOT MACHINES SCRAMBLE FOR AWARDS

(75) Inventor: Kazumasa Yoshizawa, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 1431 days.

(21) Appl. No.: 12/256,220

(22) Filed: Oct. 22, 2008

(65) Prior Publication Data

US 2009/0104996 A1 Apr. 23, 2009

(30) Foreign Application Priority Data

Oct. 22, 2007 (JP) ..... 2007-273410

(51) Int. Cl.
*G07F 17/32* (2006.01)

(52) U.S. Cl.
CPC ..... *G07F 17/3267* (2013.01); *G07F 17/32* (2013.01); *G07F 17/3276* (2013.01)

(58) Field of Classification Search
CPC ..... G07F 17/3279
USPC ..... 463/16–20, 22, 25–28, 42; 700/91, 92
See application file for complete search history.

(56) References Cited

U.S. PATENT DOCUMENTS

| | | | | |
|---|---|---|---|---|
| 6,293,865 | B1 | 9/2001 | Kelly et al. | |
| 7,883,403 | B2 * | 2/2011 | Low et al. | 463/16 |
| 2001/0049303 | A1 | 12/2001 | Found et al. | |
| 2003/0045346 | A1 * | 3/2003 | Watanabe | 463/20 |
| 2003/0236110 | A1 * | 12/2003 | Beaulieu et al. | 463/1 |
| 2005/0020340 | A1 * | 1/2005 | Cannon | 463/16 |
| 2006/0030400 | A1 * | 2/2006 | Mathis | 463/20 |
| 2007/0082725 | A1 * | 4/2007 | Low et al. | 463/16 |
| 2007/0207850 | A1 * | 9/2007 | Darrah et al. | 463/20 |
| 2007/0281775 | A1 * | 12/2007 | Kashima | 463/20 |
| 2008/0004098 | A1 * | 1/2008 | Bennett | 463/16 |
| 2009/0093298 | A1 * | 4/2009 | Michel | 463/20 |
| 2009/0104996 | A1 * | 4/2009 | Yoshizawa | 463/42 |
| 2010/0216536 | A1 * | 8/2010 | Gagner et al. | 463/16 |

* cited by examiner

*Primary Examiner* — Tramar Harper
(74) *Attorney, Agent, or Firm* — Lex IP Meister, PLLC

(57) ABSTRACT

Players of slot machines participate in a multi-player game managed by a game server by touching an adventure button randomly displayed on a liquid crystal panel. Further, the multi-player game is executed through operation of a character displayed on a game image of the liquid crystal panel by operating an attack button on the liquid crystal panel. At this point, a point amount is determined by the game server based on time points at which the attack button is operated or the like. After the time is up, a prize amount is distributed based on the point amount of each slot machine and a credit amount corresponding to the distributed prize amount is awarded to each slot machine.

3 Claims, 15 Drawing Sheets

FIG. 4

| SYMBOL NUMBER | VIDEO REEL R1 | VIDEO REEL R2 | VIDEO REEL R3 |
|---|---|---|---|
| 21 | FRANKENSTEIN | FRANKENSTEIN | FRANKENSTEIN |
| 20 | PLUM | BELL | CHERRY |
| 19 | ORANGE | APPLE | ORANGE |
| 18 | PLUM | BELL | APPLE |
| 17 | ORANGE | CHERRY | ORANGE |
| 16 | PLUM | ORANGE | PLUM |
| 15 | ORANGE | PLUM | ORANGE |
| 14 | PLUM | CHERRY | PLUM |
| 13 | BLUE 7 | BELL | ORANGE |
| 12 | CHERRY | APPLE | PLUM |
| 11 | ORANGE | BELL | ORANGE |
| 10 | BELL | STRAWBERRY | PLUM |
| 09 | ORANGE | PLUM | BELL |
| 08 | STRAWBERRY | BLUE 7 | STRAWBERRY |
| 07 | BLUE 7 | BELL | BLUE 7 |
| 06 | ORANGE | APPLE | BELL |
| 05 | APPLE | BELL | CHERRY |
| 04 | PLUM | STRAWBERRY | PLUM |
| 03 | ORANGE | PLUM | ORANGE |
| 02 | PLUM | CHERRY | PLUM |
| 01 | BLUE 7 | BELL | ORANGE |
| 00 | CHERRY | APPLE | PLUM |

| WINNING COMBINATION | | | PAYOUT AMOUNT |
|---|---|---|---|
| FRANKENSTEIN | FRANKENSTEIN | FRANKENSTEIN | 10 + FREE GAME |
| BLUE 7 | BLUE 7 | BLUE 7 | 10 |
| BELL | BELL | BELL | 8 |
| APPLE | APPLE | APPLE | 7 |
| CHERRY | CHERRY | CHERRY | 5 |
| STRAWBERRY | STRAWBERRY | STRAWBERRY | 5 |
| PLUM | PLUM | PLUM | 4 |
| ORANGE | ORANGE | ORANGE | 3 |
| CHERRY | CHERRY | (ANY) | 2 |
| ORANGE | ORANGE | (ANY) | 2 |
| CHERRY | (ANY) | (ANY) | 1 |
| ORANGE | (ANY) | (ANY) | 1 |

| RANDOM NUMBER VALUE | ADVENTURE BUTTON |
|---|---|
| 0～250 | × |
| 251～255 | ○ |

GAMING SYSTEM IN WHICH A PLURALITY OF SLOT MACHINES SCRAMBLE FOR AWARDS

CROSS-REFERENCE TO RELATED APPLICATIONS

This application claims priority from the prior Japanese Patent Application No. 2007-273410 filed on Oct. 22, 2007, the disclosure of which is herein incorporated by reference in its entirety.

BACKGROUND

1. Field

The present invention relates to a gaming system in which a plurality of slot machines scramble for awards.

2. Description of Related Art

As an example of a gaming system that has been conventionally used, there is a gaming system in which a plurality of slot machines share one progressive jackpot. In this gaming system, a portion of a bet of a unit game is accumulated in a jackpot fund whenever a unit game is conducted in each slot machine. If a specific winning combination is realized at a unit game of an arbitrary slot machine, the jackpot fund is awarded to the applicable slot machine. After that, the jackpot fund is reset.

Related art document information related to a gaming system in which awards are scrambled for among players using a network includes, for example, US Patent Laid-Open No. 2001/0049303 and U.S. Pat. No. 6,293,865.

However, in this gaming system, while a jackpot fund can be scrambled for among a plurality of slot machines a game in which acquired prizes are shared among the plurality of slot machines cannot be executed.

SUMMARY

Thus, the present invention has been made in view of the above respects and a subject of the present invention is to provide a gaming system in which players can share acquired prizes among slot machines.

To achieve the object of the disclosure, there is provided a gaming system, comprising: game clients constituted by a plurality of slot machines; and a game server that manages each of the game clients, wherein each of the game clients includes a display and an input device and is programmed to execute the following processes (a) to (e) of: (a) awarding a participation right randomly during a slot game; (b) if data indicating that the participation right is executed is input by a player through the input device, transmitting entry information including a notification of participation of the game client in a multi-player game in which prizes are distributed to the game server; (c) if the following game start information or the following game content information is received from the game server, executing the multi-player game on the display based on the game start information or the game content information; (d) if the player inputs operation data of the multi-player game through the input device while the multi-player game is being executed on the display, transmitting game operation information on the operation data of the multi-player game to the game server; and (e) if the following game result information is received from the game server, calculating a total amount of credits based on the game result information, and the game server is programmed to execute the following processes (α) to (ε) of: (α) if the entry information is received, determining the game client that has transmitted the entry information as a participant of the multi-player game; (β) if the number of game clients determined by the (α) as participants reaches a predetermined number, transmitting game start information notifying that the multi-player game is started to the game client; (γ) if the game operation information is received, determining a position or result of the multi-player game based on the game operation information; (δ) if the position of the multi-player game is determined in the (γ), transmitting game content information on the position of the multi-player game determined in the (γ) to each game client to which the game start information is transmitted in the (β); and (ε) if the result of the multi-player game is determined in the (γ), transmitting game result information notifying that acquired prizes are awarded after being divided as the result of the multi-player game determined in the (γ) to each game client to which the game start information is transmitted in the (β).

BRIEF DESCRIPTION OF THE DRAWINGS

FIG. 4 is a schematic view showing symbol columns drawn on each video reel;

DETAILED DESCRIPTION

[1. Outline of the Invention]

Figure 1:
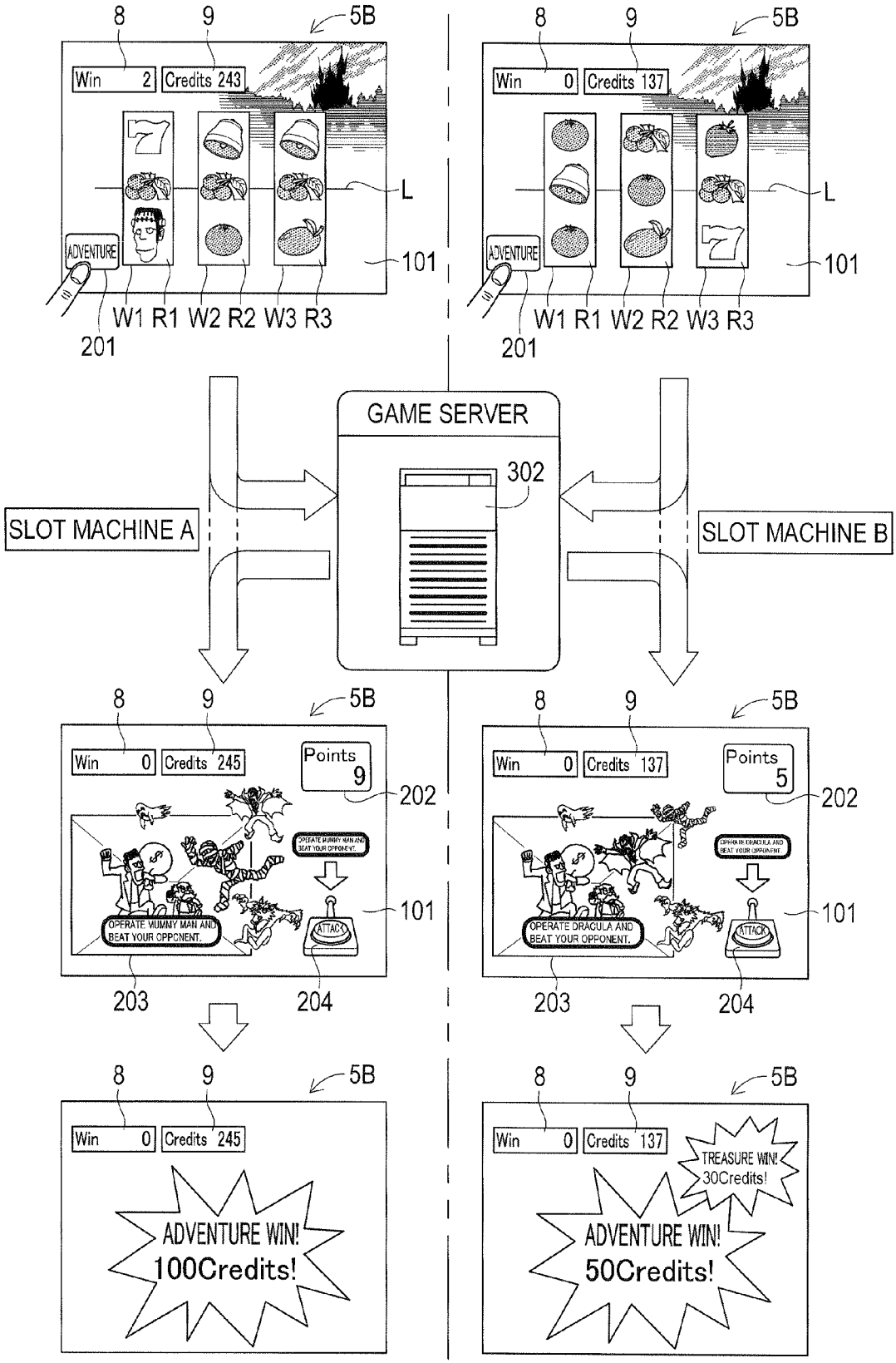
FIG. 1 is a view showing characteristics of a gaming system according to one embodiment of the present invention.

Hereinafter, embodiments of the invention will be described with reference to the accompanying drawings. In a gaming system according to this embodiment, a plurality of slot machines are connected to a game server through a network that enables bidirectional communication. FIG. 1 is a view showing the characteristics of a gaming system according to an embodiment of the invention.

FIG. 1 shows a slot machine A and a slot machine B as the plurality of slot machines connected to a game server 302. Each liquid crystal panel 5B provided in the slot machine A and the slot machine B is formed of a publicly known liquid crystal panel and a slot game is executed on the liquid crystal panel 5B.

In this respect, in each liquid crystal panel 5B, as shown in the upper part of FIG. 1, symbols of three video reels R1, R2, and R3 are arranged three by three on three display windows W1, W2, and W3. One pay line L, which horizontally crosses the display windows W1, W2, and W3, is displayed on each liquid crystal panel 5B. The pay line L is used to specify a combination of symbols. A touch panel 101 is provided in front of each liquid crystal panel 5B. Further, as shown in each parts of FIG. 1, a payout amount display portion 8 and a credit amount display portion 9 are provided in each liquid crystal panel 5B.

During a slot game, on the other hand, various winning combinations are preset based on combinations of each symbol. Further, during a slot game, three symbols are rearranged on each display window W1, W2, and W3 by each video reel R1, R2, and R3 being rotated and stopped respectively. If, at this point, the combination of symbols constituted by three symbols rearranged on the pay line L corresponds to one of winning combinations, an amount obtained by multiplying the payout amount corresponding to the winning combination with the bet amount is displayed on the payout amount display portion 8. This constitutes a unit game of a slot game. The payout amount displayed on the payout amount display portion 8 is added and displayed on the credit amount display portion 9 when the unit game is finished.

In a gaming system according to the present embodiment, however, a adventure button 201 may be displayed on the liquid crystal panel 5B during the slot game.

Then, if a player touches the adventure button 201 via the touch panel 101, data for notification of participation in a multi-player game on which the total amount of prizes acquired by all participants is proportionally distributed in accordance with the degree of contribution of each participant is transmitted to the game server 302.

In FIG. 1, a player of the slot machine A touches the adventure button 201 via the touch panel 101 and thus, data for notification of participation of the slot machine A in a multi-player game is transmitted to the game server 302. Also, a player of the slot machine B, on the other hand, touches the adventure button 201 via the touch panel 101 and thus, data for notification of participation of the slot machine B in a multi-player game is transmitted to the game server 302.

On the other hand, the game server 302 transmits game start information including data for notification of starting a multi-player game to each slot machine participating in the multi-player game. The multi-player game is thereby started by each slot machine participating in the multi-player game. If, as shown, for example, in FIG. 1, the slot machine A and the slot machine B will participate in a multi-player game, the display windows W1, W2, and W3, the video reels R1, R2, and R3, the pay line L, and the adventure button 201 are erased on each liquid crystal panel 5B of the slot machine A and the slot machine B and instead, as shown in the middle of FIG. 1, a point display portion 202, a game image 203 in which each character (such as Dracula, a ghost, a mummy man, and a wolfman), Frankenstein and the like appear, an attack button 204 and the like are displayed. A multi-player game is thereby started between the slot machine A and the slot machine B.

Then, the liquid crystal panel 5B of the slot machine A has [OPERATE MUMMY MAN AND BEAT YOUR OPPONENT.] displayed thereon and a player of the slot machine A performs a game operation to beat Frankenstein through operation of the mummy man by touching the attack button 204 via the touch panel 101. At this point, game operation information including data for notification of time points at which the player of the slot machine A touched the attack button 204 via the touch panel 101 and the like is transmitted from the slot machine A to the game server 302. The game server 302, on the other hand, determines a point amount counted as a degree of contribution based on the game operation information, the value of hit points of the mummy man and the like and returns game content information including data for notification of the determined point amount to the slot machine A. Accordingly, in the slot machine A, the point amount included in the game content information are added and displayed on the point display portion 202 of the liquid crystal panel 5B.

Similarly, the liquid crystal panel 5B of the slot machine B has [OPERATE DRACULA AND BEAT YOUR OPPONENT.] displayed thereon and a player of the slot machine B performs a game operation to beat Frankenstein through operation of Dracula by touching the attack button 204 via the touch panel 101. At this point, game operation information including data for notification of time points at which the player of the slot machine B touched the attack button 204 via the touch panel 101 and the like is transmitted from the slot machine B to the game server 302. The game server 302, on the other hand, determines a point amount counted as a degree of contribution based on the game operation information, the number of hit points of Dracula and the like and returns game content information including data for notification of the determined point amount to the slot machine B. Accordingly, in the slot machine B, the point amount included in the game content information are added and displayed on the point display portion 202 of the liquid crystal panel 5B.

Incidentally, a character operated in a multi-player game is preset to each slot machine. In the case of FIG. 1, the character of mummy man is preset for the slot machine A and that of Dracula for the slot machine B. The value of hit points of each character operable in a multi-player game is randomly determined by the game server 302 before the multi-player game is started. Further, the game server 302 enters data for notification of the value of hit points thereof in the game start information to have an influence on the character operation in each slot machine based on the value of hit points thereof.

Then, when the game server 302 determines to end the multi-player game, it divides the total amount of prizes in accordance with the point amount held by each slot machine and creates game result information including data for notification of awarding of a credit amount corresponding to the divided prize amount for each slot machine before transmitting the game result information. The game result information includes data for notification of an end of the multi-player game.

Then, each slot machine that has received the game result information displays the credit amount awarded to the slot machine. In the case of FIG. 1, the liquid crystal panel 5B of each of the slot machine A and the slot machine B displays a screen as shown, for example, at the bottom of FIG. 1.

In other words, the point display portion 202, the game image 203, and the attack button 204 are erased from the liquid crystal panel 5B of the slot machine A and instead, as shown at the bottom of FIG. 1, [ADVENTURE WIN! 100 Credits!] indicating that a credit amount of [100] has been awarded in the multi-player game is displayed. Although not shown in FIG. 1, the credit amount of [100] awarded in the multi-player game is added and displayed on the credit amount display portion 9.

This is just as with the liquid crystal panel 5B of the slot machine B. That is, the point display portion 202, the game image 203, and the attack button 204 are erased from the liquid crystal panel 5B of the slot machine B and instead, as shown at the bottom of FIG. 1, [ADVENTURE WIN! 50 Credits!] indicating that a credit amount of [50] has been awarded in the multi-player game is displayed. Although not shown in FIG. 1, the credit amount of [50] awarded in the multi-player game is added and displayed on the credit amount display portion 9.

Moreover, when the game server 302 determines to end the multi-player game, it determines to award an extra prize to one of slot machines participating in the multi-player game by lottery and enters data for notification of awarding of a credit amount corresponding to the extra prize in game result information to be transmitted to the determined slot machine. In the case of FIG. 1, the extra prize is awarded to the slot machine B and, as shown at the bottom of FIG. 1, [TREASURE WIN! 30 Credits!] indicating that a credit amount of [30] of the extra prize is displayed on the liquid crystal panel 5B of the slot machine B. Although not shown in FIG. 1, the credit amount of [30] awarded as the extra prize in the multi-player game is also added and displayed on the credit amount display portion 9.

[2. Schematic Structure of the Gaming System]

Hereinafter, one embodiment embodying the present invention is described with reference to the drawings.

Figure 2:
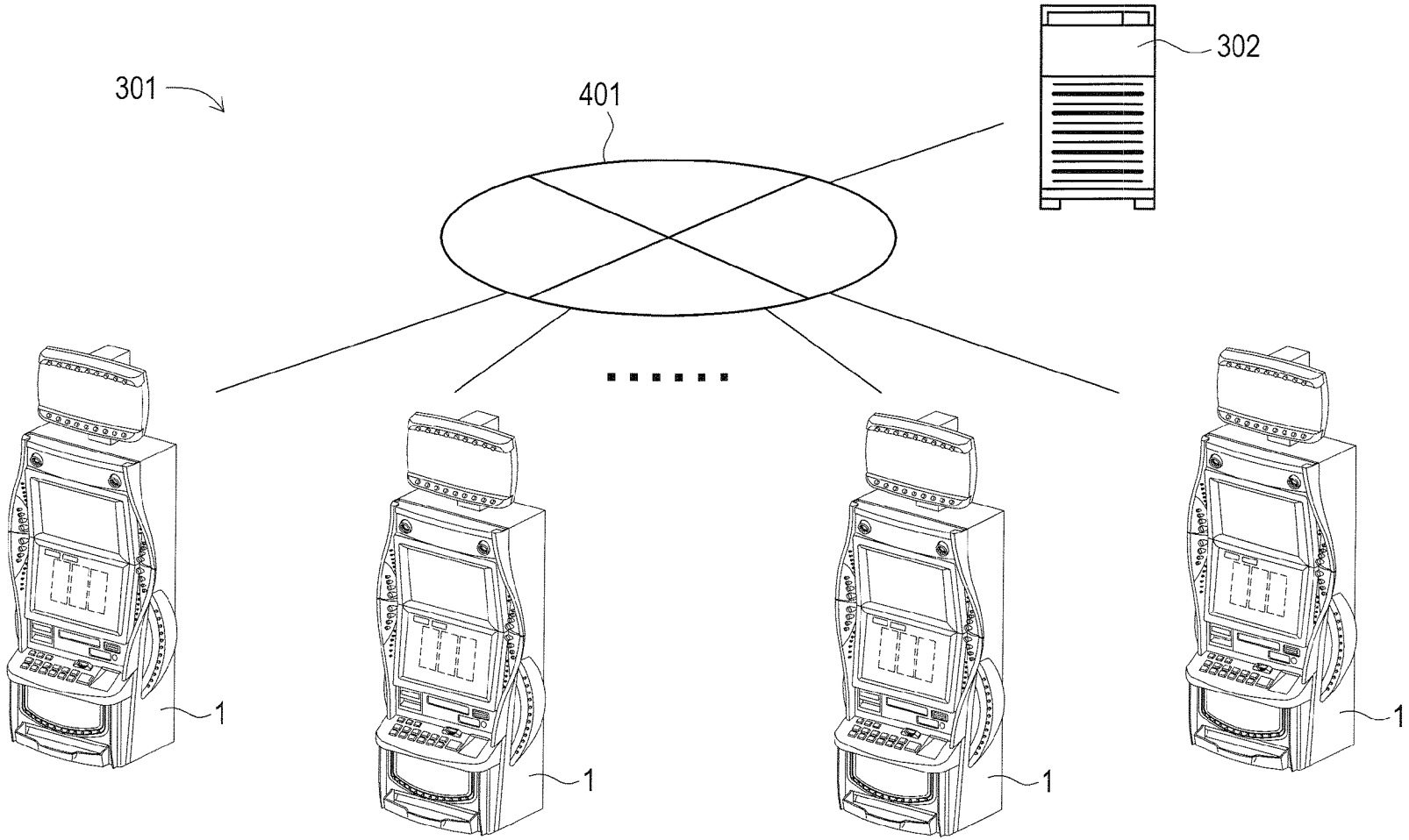
FIG. 2 is a system block diagram showing the gaming system.

FIG. 2 is a system block diagram showing a gaming system 301 of the present embodiment. As shown in FIG. 2, the gaming system 301 of the present embodiment includes a network 401 of two-way communicable through which a game server 302 and a plurality of slot machines 1 are connected.

[3. Schematic Structure of Each Slot Machine]

Figure 3:
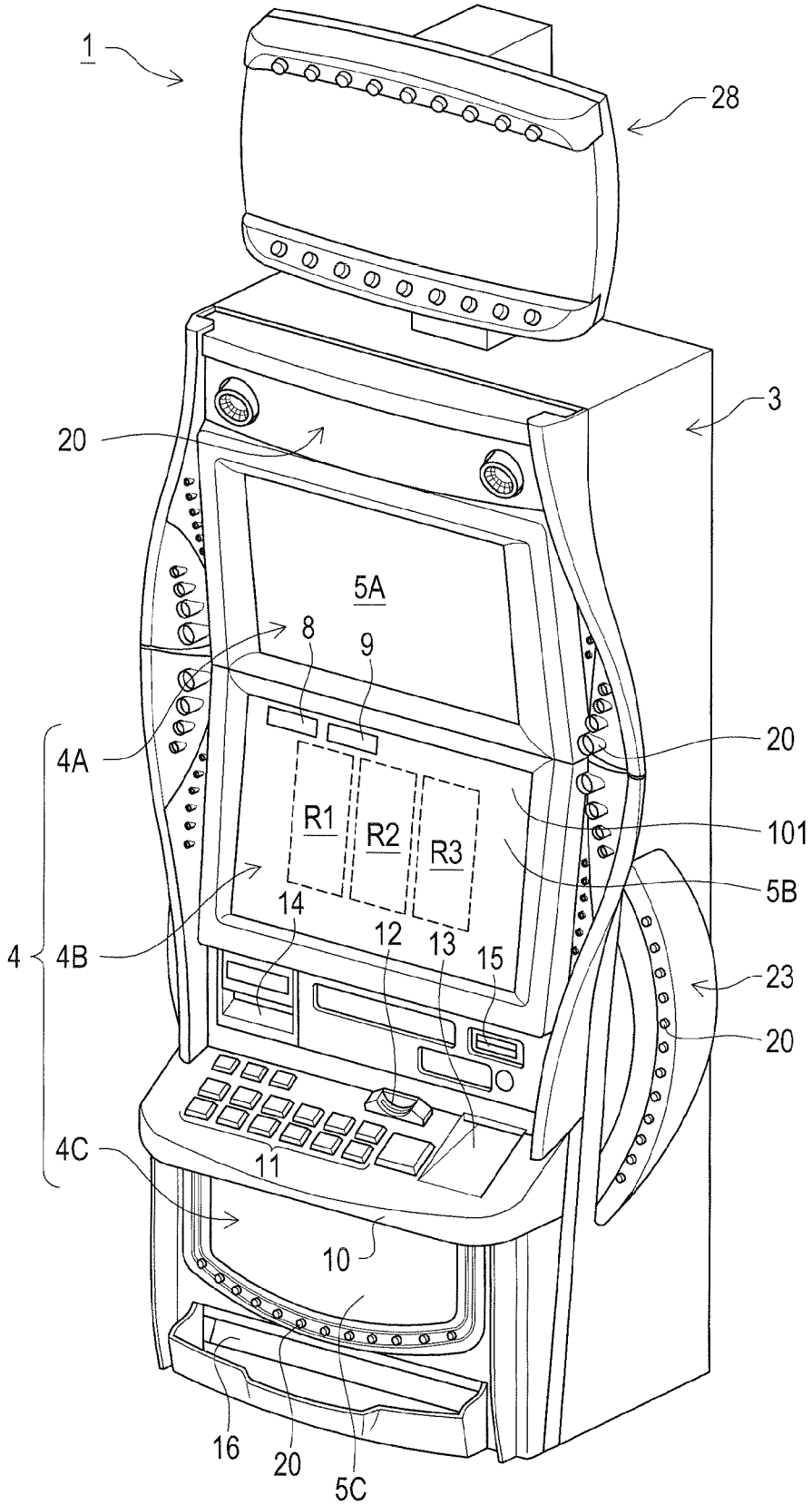
FIG. 3 is an external perspective view of each slot machine.

Next, a schematic structure of each slot machine 1 will be described by referring to FIG. 3. FIG. 3 is an external perspective view of each slot machine 1.

As shown in FIG. 3, each slot machine 1 is of an upright type which is equipped with a game arcade such as casino and includes a cabinet 3 for housing electric or mechanical parts for conducting predetermined types of games. A display unit 4 for displaying information related to a game includes, for example, an upper display unit 4A, a variable display unit 4B at the middle stage of the display unit 4, and an under display unit 4C, which are installed at the front face of the cabinet 3 in a vertically long shape. The upper display unit 4A includes a liquid crystal panel 5A arranged at the upper side of the variable display unit 4B, the liquid crystal panel 5A for displaying an effecting images, an introduction of a game, or an explanation of game rules and the like. The under display unit 4C is arranged at the lower side of the variable display unit 4B and includes a plastic panel 5C on which an image is printed. The plastic panel 5C is lighted up with the backlight of the under display unit 4C.

The variable display unit 4B for displaying a state of a game includes the liquid crystal panel 5B which is fixed at a front door of the cabinet 3. On the liquid crystal display panel 5B, the symbols of three video reels R1, R2 and R3 are rotated and stopped. In the middle variable display portion 4B, one pay line L horizontally crossing each of areas corresponding to the video reels R1, R1 and R3 is displayed on the liquid crystal display panel 5B.

Additionally, a touch panel 101 is provided on the front side of the liquid crystal panel 5B. A player may input his/her various instructions by operating the touch panel 101. On the upper position of the middle variable display portion 4B, the payout amount display portion 8 and the credit amount display portion 9 are arranged on the liquid crystal panel 5B. Also the upper portion of the middle variable display portion 4B, is related to the back side, thereby the player may play games in a cozy posture.

Figures 7, 8:
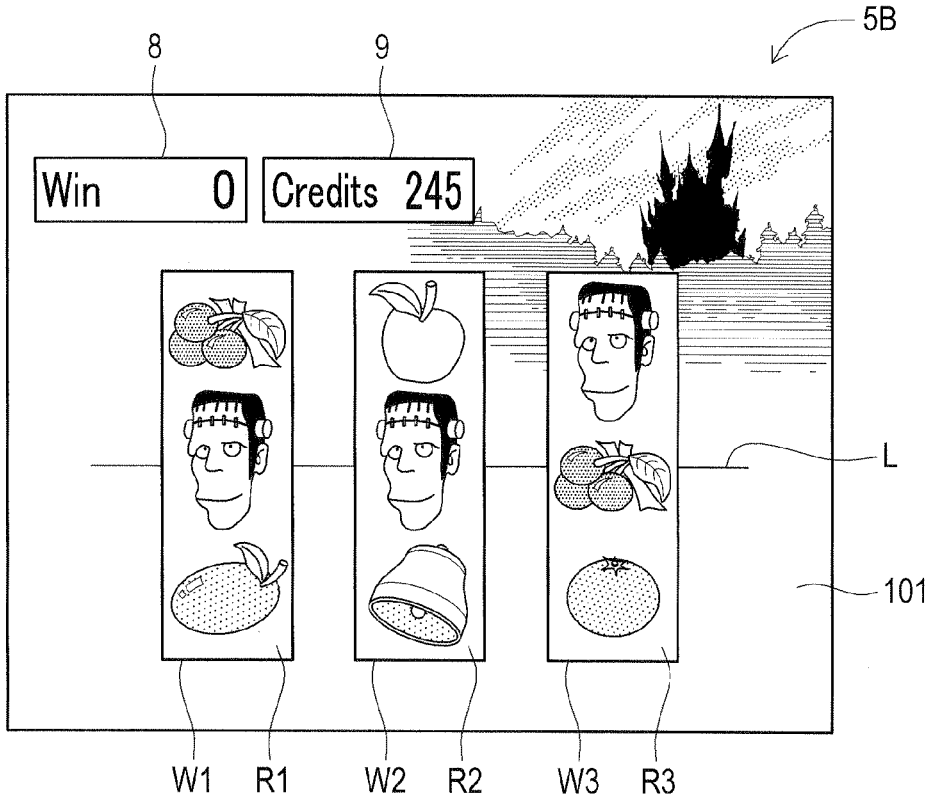
FIG. 7 is a payout table showing winning combinations and payout amounts thereof when a slot game is executed by using each video reel.
FIG. 8 is a view showing an image example displayed on the liquid crystal panel.
Figure 9:
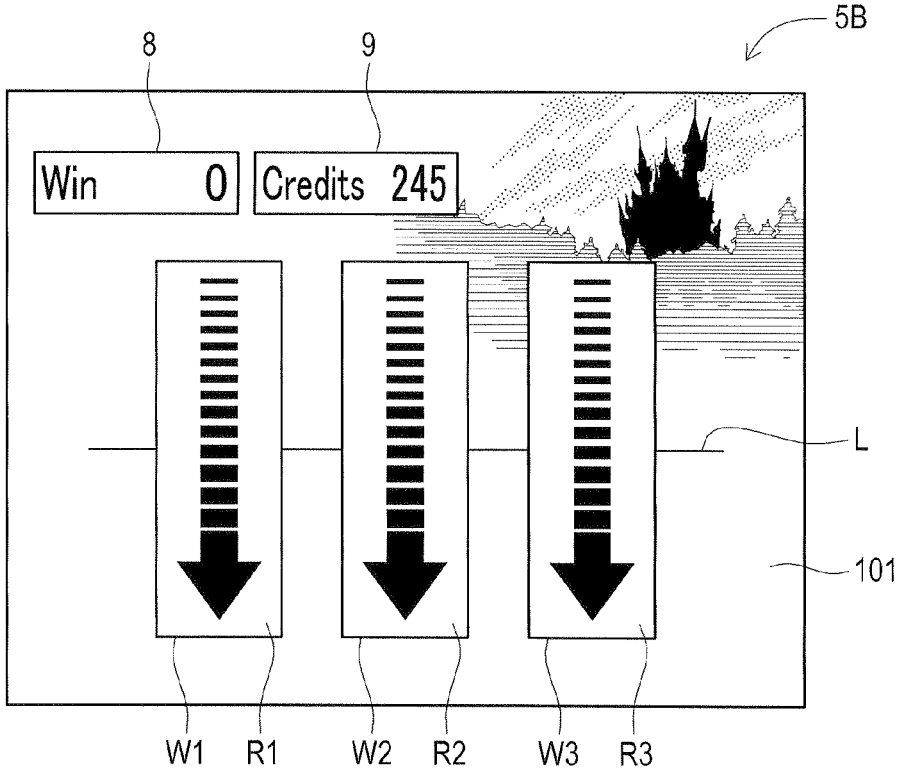
FIG. 9 is a view showing an image example displayed on the liquid crystal panel.

Here, the image of the slot game displayed on the liquid crystal panel 5B will be explained. FIG. 8 and FIG. 9 are the figures showing the contents displayed on the liquid crystal panel 5B. On each display window W1, W2 and W3 of the liquid crystal panel 5B, during the slot game, as shown in FIG. 8 and FIG. 9, the symbols drawn on the reel band of each video reel R1, R2, and R3 are displayed to be visible to a player. FIG. 8 shows the arranged or rearranged state of the symbols which are drawn on the reel band of each video reel R1, R2 and R3, on each display window W1, W2 and W3 of the liquid crystal panel 5B. FIG. 9 shows the rotating state of the symbols which are drawn on the reel band of each video reel R1, R2 and R3, on each display window W1, W2 and W3 of the liquid crystal panel 5B. On the reel band of each video reel R1, R2 and R3, a symbol column constructed from twenty-two symbol is drawn respectively (refer to FIG. 4).

On the liquid crystal panel 5B, the payout amount display portion 8 and the credit amount display portion 9 are arranged. On the payout amount display portion 8, the payout amount obtained during the slot game by the player is displayed. On the credit amount display portion 9, the credit amount which is owned by the current player is displayed. Also, on the payout amount display portion 8, the payout amount obtained in the free game by the player is displayed.

Therefore, on the each display window W1, W2 and W3 of the liquid crystal panel 5B during the slot game, three symbols which are drawn on the reel band of each video reel R1, R2 and R3 are arranged. On the liquid crystal panel 5B during the slot game, as shown in FIG. 8 and FIG. 9, the pay line L crossing each display window W1, W2 and W3 horizontally is displayed. The pay line L is used to specify the symbol combination.

Returning to FIG. 3, between the middle variable display portion 4B and the lower display portion 4C, at the front of the cabinet 3, an operation table 10 which is projected forward is arranged. On the operation table 10, a variety of operation buttons 11 including a BET button, a collecting button, a spin button, a CASHOUT button and the like are arranged as the operation portion to execute the game. On the operation table 10, a coin insertion slot 12 and a bill insertion portion 13 are arranged. Also between the operation table 10 and the middle variable display portion 4B, a ticket printer 14 and a card reader 15 are arranged. At the lowest position of the cabinet 3, a coin tray 16 is also arranged.

As to each slot machine 1, coins, bills or electronic value information (credit) corresponding to coins and bills are used as gaming media. However, in the present invention, types of gaming media are not restricted to the above. For example, medal, token, electronic money, ticket and the like are applicable as gaming media.

On the cabinet 3 of each slot machine 1, light emitting portions 20 are arranged around the game area including the upper display portion 4A, the middle variable display portion 4B, the lower display portion 4C and the operation table 10.

The slot machine 1 also includes a topper effect device 28 which is installed on the cabinet 3. The topper effect device 28 is shaped in a rectangular board shaped, and is arranged almost parallel to the liquid crystal panel 5A of the upper display portion 4A. The cabinet 3 is further provided with speakers 23 on its both sides.

[4. Outline of the Symbols]

Next, the symbols drawn on the reel band of each video reel R1, R2 and R3 will be explained with reference to FIG. 4. These symbols are scrolled and rearranged on each display window W1, W2 and W3 of the liquid crystal panel 5B during the slot game and the free game. FIG. 4 is a schematic view schematically showing symbol columns drawn on the reel band of each video reel R1, R2 and R3.

On the reel band of each video reel R1, R2 and R3, twenty-two symbols are drawn respectively. Each symbol column is constructed from the symbols including [FRANKENSTEIN], [BLUE7], [BELL], [APPLE], [CHERRY], [STRAWBERRY], [PLUM] and [ORANGE]. And the symbols of the predetermined types are arranged in a predetermined sequence.

If three of any of the following symbols: [BLUE7], [BELL], [APPLE], [CHERRY], [STRAWBERRY], [PLUM] and [ORANGE] have been rearranged on the pay line L of the liquid crystal panel 5B, a payout amount obtained by multiplying a predetermined payout amount with a bet amount is awarded to a player (refer to FIG. 7). If one or two of symbols [CHERRY] or [ORANGE] have been rearranged on the pay line L of the liquid crystal panel 5B, a payout amount obtained by multiplying a predetermined payout amount with a bet amount is awarded to a player in accordance with the number of the rearranged symbols (refer to FIG. 7).

When three symbols of [FRANKENSTEIN] are rearranged on the pay line L of the liquid crystal panel 5B, a payout amount obtained by multiplying a predetermined payout amount with a bet amount is awarded to a player, and also the game shifts to a free game.

In each symbol sequence shown in FIG. 4, a symbol number is allocated with respect to each symbol constituting these symbol columns, starting from the top.

[5. Internal Configuration of Each Slot Machine]

Next, the internal construction of the above slot machine 1 will be explained with reference to FIG. 5 and FIG. 6.

Figure 5:
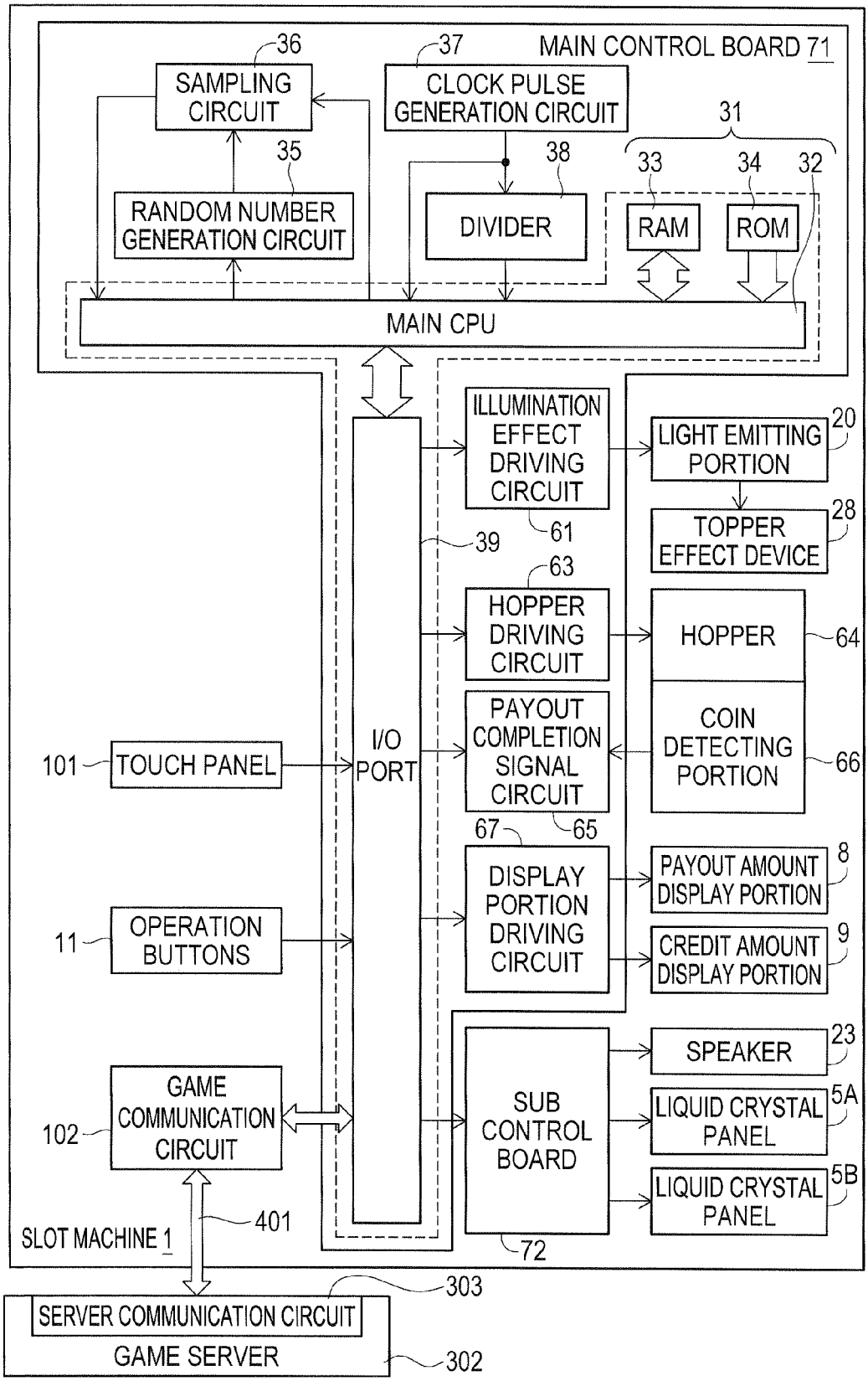
FIG. 5 is a block diagram schematically showing an internal construction of entire slot machine.
Figure 6:
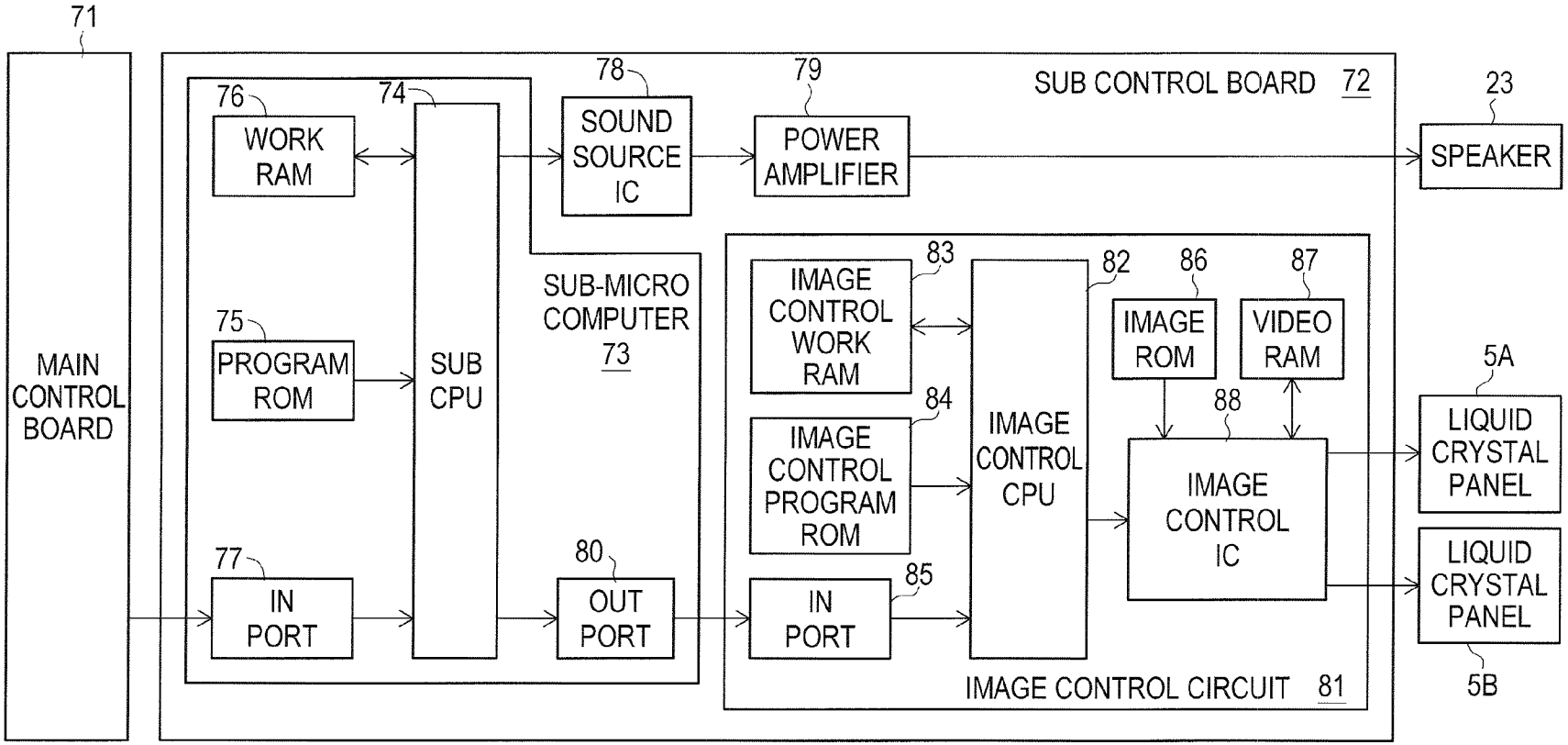
FIG. 6 is a block diagram schematically showing an internal construction of a sub control board.

FIG. 5 is a block diagram schematically showing the internal construction of entire slot machine 1. As shown in FIG. 5, the slot machine 1 includes a plurality of construction elements such as a main control board 71, in which a microcomputer 31 is included. The main control board 71 is constructed from the microcomputer 31, a random number generation circuit 35, a sampling circuit 36, a clock pulse generation circuit 37 and a frequency divider 38. The main control board 71 also includes an illumination effect driving circuit 61, a hopper driving circuit 63, a payout completion signal circuit 65, a display portion driving circuit 67 and a game communication circuit 102.

The microcomputer 31 is constructed from a main CPU 32, a RAM 33 and a ROM 34. The main CPU 32 runs based on the programs stored in the ROM 34, and inputs/outputs signals with other elements through I/O port 39, so as to execute the control of the entire slot machine 1. Data and programs used when the main CPU 32 runs are stored in the RAM 33. For example, random numbers which are sampled by the after-mentioned sampling circuit 36 are stored temporarily after the start of the game, also the code numbers of each video reel R1, R2 and R3, the symbol numbers are stored in the RAM 33. And the programs executed by the main CPU 32 and the permanent data are stored in the ROM 34.

Especially, the programs stored in the ROM 34 include the game programs and the gaming system programs (abbreviated as [the game programs and the like] hereinafter). And a lottery programs mentioned below is also included in the game programs.

The lottery program is a program used to determine the code numbers of each video reel R1, R2 and R3 which corresponds to each symbol rearranged on the pay line L of the liquid crystal panel 5B. In the lottery program, it is included symbol weighing data corresponding to each of plural kinds of payout rates (for example, 80%, 84%, and 88%). The symbol weighing data are the data indicating correlation between the code number of each reel and one or plural random numbers belonging to a predetermined number range (0 to 255), every each of the three video reels R1, R2 and R3. In other words, each of the code number of one reel is associated with one or more random numbers corresponding to the payout rate. The random number is extracted by the lottery program, and the symbol specified finally by the random number is rearranged on the pay line L of the liquid crystal panel 5B.

Random numbers over a predetermined range are generated by the random number generation circuit 35, which is operated based on the instructions from the main CPU 32. The random numbers are voluntarily extracted from the random numbers generated by the random number generation circuit 35 by the sampling circuit 36, based on the instructions from the main CPU 32, and the extracted random numbers are input to the main CPU 32. The base clock for running the main CPU 32 is generated by the clock pulse generation circuit 37, and the signals which are generated by dividing the base clock in a predetermined frequency are input to the main CPU 32 by the frequency divider 38.

Furthermore, the touch panel 101 is connected to the main control board 71. The touch panel 101 is arranged in front of the liquid crystal panel 5B, and specifies the coordinate position of the portion touched by the player. The position on which the player touched and the direction of the movement of the touched portion are determined based on the specified coordinate position information. And the signals corresponding to the determination are input to the main CPU 32 through I/O port 39.

Also, the operation buttons 11 for instructing the execution of the game are connected to the main control board 71. The operation buttons 11 include the spin button, the collecting button, the BET button and the like. The signals corresponding to the pressing of these buttons are input to the main CPU 32 through I/O port 39.

The effect signals which are used to conduct illumination effect are output to the above-mentioned light emitting portion 20 and topper effect device 28 by the illumination effect driving circuit 61. And the topper effect device 28 is serially connected to the illumination effect driving circuit 61 through light emitting portions 20.

A hopper 64 is driven by the hopper driving circuit 63 based on the control of main CPU 32. The hopper 64 executes the payout of coins, and coins are paid out from the coin tray 16. The data of the number of coins are input from the connected coin detecting portion 66 by the payout completion signal circuit 65. When the number of coins becomes a predetermined number, the signal indicating the completion of the coins is input to the main CPU 32. The number of the coins paid out from the hopper 64 is calculated by the coin detecting portion 66, and the data of the number calculated are input to the payout completion signal circuit 65. The display operation of the payout amount display portion 8 and credit amount display portion 9 is controlled by the display portion driving circuit 67.

The game communication circuit 102 is a device that converts a signal sent to be sent out by the slot machine 1 into a signal in a sendable format, according to transmission method of a phone line or a LAN cable, so as to send it to the game server 302. Conversely, the game communication circuit 102 receives a signal sent from the game server 302 to reconvert the signal into a signal in a format readable by the slot machine 1. The game communication circuit 102 is connected to a server communication circuit 303 via the network 401 of two-way communicable, such as the Internet.

Furthermore, a sub control board 72 is connected to the main control board 71. As shown in FIG. 6, commands from the main control board 71 are input to the sub control board 72. The display control on the liquid crystal panel 5A of the upper display portion 4A and the liquid crystal panel 5B of the variable display portion 4B, and the sound output control on the speaker 23 are executed by the sub control board 72. The sub control board 72 is constructed on a circuit board different from the circuit board for the main control board 71, and includes a microcomputer 73 (abbreviated as [sub-microcomputer] hereinafter) as a main construction element, and a sound source IC 78, a power amplifier 79 and an image control circuit 81. The sound source IC 78 controls the sound output from the speaker 23, the power amplifier 79 is used as an amplification device, and the image control circuit 81 is used as the display control device of the liquid crystal panel 5A and 5B.

The sub-microcomputer 73 includes a sub CPU 74, a program ROM 75, a work RAM 76, an IN port 77 and an OUT port 80. The control operations are executed by sub CPU 74 based on the control order transmitted from the main control board 71, the program ROM 75 is used as a memory device. Although a clock pulse generation circuit, a frequency divider, a random number generation circuit and a sampling circuit are not included in the sub control board 72, the sub control board 72 is constructed so as to execute random number sampling according to the operation programs thereof. The control programs executed by the sub CPU 74 are stored in the program ROM 75. The work RAM 76 is constructed as a temporary storing means when the above control programs are executed by the sub CPU 74.

The image control circuit 81 includes an image control CPU 82, an image control work RAM 83, an image control program ROM 84, an IN port 85, an image ROM 86, a video RAM 87 and an image control IC 88. The images displayed on the liquid crystal panel 5A and 5B are determined by the image control CPU 82, based on the parameters set by the sub-microcomputer 73, according to the image control programs stored in the image control program ROM 84.

The image control programs regarding to the display of the liquid crystal panel 5A, 5B and a variety of the selection tables are stored in the image control program ROM 84. The image control work RAM 83 is constructed as a temporary storing means when the image control programs are executed by image control CPU 82. Images corresponding to the content determined by the image control CPU 82 are formed by the image control IC 88, and are output to the liquid crystal panel 5A, 5B.

In the image ROM 86, the dot data used to form images are stored. Therefore, the dot data related to the symbols drawn on the reel band of each video reel R1, R2 and R3 are stored in the image ROM 86. The video RAM 87 runs as a temporary storing means when the images are formed by the image control IC 88.

Further, the image control circuit 81 executes display control of the rotation display/stop display of the video reels R1, R2, and R3 on each display window W1, W2 and W3 of the liquid crystal panel 5B, based on control signals from the main CPU 32.

[6. Outline of the Slot Game]

Next, winning combinations and the payout amounts corresponding to the winning combinations will be explained with reference to FIG. 7, wherein the winning combinations are the symbol combinations when the slot game is executed by using each video reel R1, R2 and R3 in each slot machine 1. FIG. 7 is a payout table in which the winning combinations and the payout amounts corresponding to the winning combinations are shown when the slot game is executed by using each video reel R1, R2 and R3 in each slot machine 1.

Here, the payout amount shown in FIG. 7 indicates the payout amount when the bet amount is [1] during the slot game. Therefore, when the bet amount is [1], the payout amount shown in FIG. 7 is awarded, and when the bet amount is more than [2], the payout amount obtained by multiplying the payout amount shown in FIG. 7 with the bet amount is awarded.

Thereby, when three symbols of [FRANKENSTEIN] are rearranged on the pay line L of the liquid crystal panel 5B, the payout amount obtained by multiplying 10 credits with the bet amount is awarded. Additionally, the bonus trigger is realized, the free game is generated. Also, in the free game, the bonus trigger may be realized, at that time, a new free game is generated.

When three symbols of [BLUE 7] are rearranged on the pay line L of the liquid crystal panel 5B, the payout amount obtained by multiplying 10 credits with the bet amount is awarded.

When three symbols of [BELL] are rearranged on the pay line L of the liquid crystal panel 5B, the payout amount obtained by multiplying 8 credits with the bet amount is awarded.

The payout amount corresponding to each winning combination shown in FIG. 7, are set as the same in the above.

However, when a symbol combination constructed from the symbols rearranged on the pay line L of the liquid crystal panel 5B, is not any of the winning combinations shown in FIG. 7, the symbol combination is not a winning combination. Therefore, no credits may be awarded.

As mentioned above, in each slot machine 1, the slot game and the free game is executed.

In other words, during the slot game, a game is executed by rearranging a specific symbol combination by using each video reel R1, R2 and R3 on the pay line L of the liquid crystal panel 5B. During the slot game, firstly, a part of symbol column (three symbols) drawn on the reel band of each video reel R1, R2 and R3 shown in FIG. 4, is arranged on each window W1, W2 and W3 of the liquid crystal panel 5B (refer to FIG. 8). Here, after the player sets the bet amount by pressing the BET button among the operation buttons 11, if the player presses the spin button among the operation buttons 11, each video reel R1, R2 and R3 rotates, the symbol column drawn on the reel band of each video reel R1, R2 and R3 shown in FIG. 4, is scrolled from up to down and displayed on each window W1, W2 and W3 of the liquid crystal panel 5B (refer to FIG. 9).

After a predetermined time, each video reel R1, R2 and R3 stops automatically, a part of the symbol column (three symbols) drawn on the reel band of each video reel R1, R2 and R3 shown in FIG. 4, is rearranged on each window W1, W2 and W3 of the liquid crystal panel 5B (refer to FIG. 8). On the other hand, each winning combination based on each symbol combination is determined beforehand (refer to FIG. 7). When the symbol combination constructed from the three symbols rearranged on the pay line L of the liquid crystal panel 5B, realizes a winning combination, the payout amount obtained by multiplying the payout amount corresponding to the realized winning combination with the bet amount is awarded to the player.

On the other hand, in the free game, the game, in which a specific symbol combination is rearranged by using each video reel R1, R2 and R3 on the pay line L of the liquid crystal panel 5B, is repeated over a predetermined number of times. Also, in the free game, a part of the symbol column (three symbols) drawn on the reel band of each video reel R1, R2 and R3 as shown in FIG. 4, is arranged on each window W1, W2 and W3 of the liquid crystal panel 5B (refer to FIG. 8). However, here, after a predetermined time, each video reel R1, R2 and R3 rotates automatically. Thereby, no matter whether the player presses the operation buttons 11 such as the BET button or the spin button, the symbol column drawn on the reel band of each video reel R1, R2 and R3 as shown in FIG. 4 is scrolled from up to down and displayed on each window W1, W2 and W3 of the liquid crystal panel 5B (refer to FIG. 9).

Furthermore, after a predetermined time, each video reel R1, R2 and R3 stops automatically, a part of the symbol column (three symbols) drawn on the reel band of each video reel R1, R2 and R3 as shown in FIG. 4, is rearranged on each window W1, W2 and W3 of the liquid crystal panel 5B (refer to FIG. 8). On the other hand, similar to the above slot game, each kind of winning combination is determined beforehand based on the symbol combination (refer to FIG. 7). When the symbol combination, which is constructed from the three symbols rearranged on the pay line L of the liquid crystal panel 5B, realizes a winning combination, the payout amount obtained by multiplying the payout amount corresponding to the realized winning combination with the bet amount is awarded to the player.

The predetermined number of times for the free game (for example, 20 times) is set in advance.

[7. Outline of the Multi-Player Game]

Figure 10:
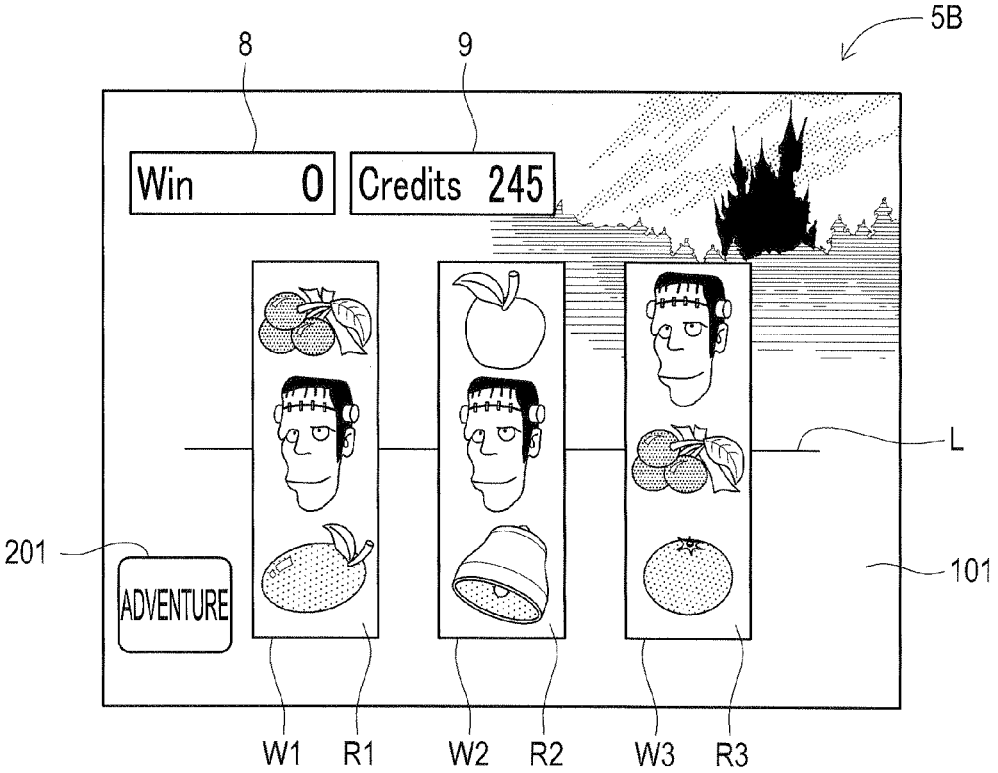
FIG. 10 is a view showing an image example displayed on the liquid crystal panel.

As shown in FIG. 10, the adventure button 201 may be displayed on the liquid crystal panel 5B during a slot game.

Then, when a player touches the adventure button 201 displayed on the liquid crystal panel 5B via the touch panel 101, the player can participate in a multi-player game operated by the game server 302 on condition that the total amount of acquired prizes be proportionally distributed among all participants in accordance with the degree of contribution of each participant.

The game server 302 receives a notification of participation in a multi-player game from each slot machine 1 within a predetermined time period. While a notification thereof is being received, the game server 302 produces an effect of a multi-player game by causing the liquid crystal panel 5B of each slot machine 1 that made a notification of participation in the multi-player game to display an entry screen as shown, for example, in FIG. 11.

Then, when the period of reception ends, the game server 302 randomly determines the value of hit points of each character (Dracula, a ghost, a mummy man, a wolfman and the like) preset to each slot machine 1 participating in the multi-player game. Further, the game server 302 introduces each slot machine 1 participating in the multi-player game together with the character preset to the slot machine 1 and the value of hit points of the character by causing the liquid crystal panel 5B of each slot machine 1 participating in the multi-player game to display a matching screen as displayed, for example, in FIG. 12.

Figure 12:
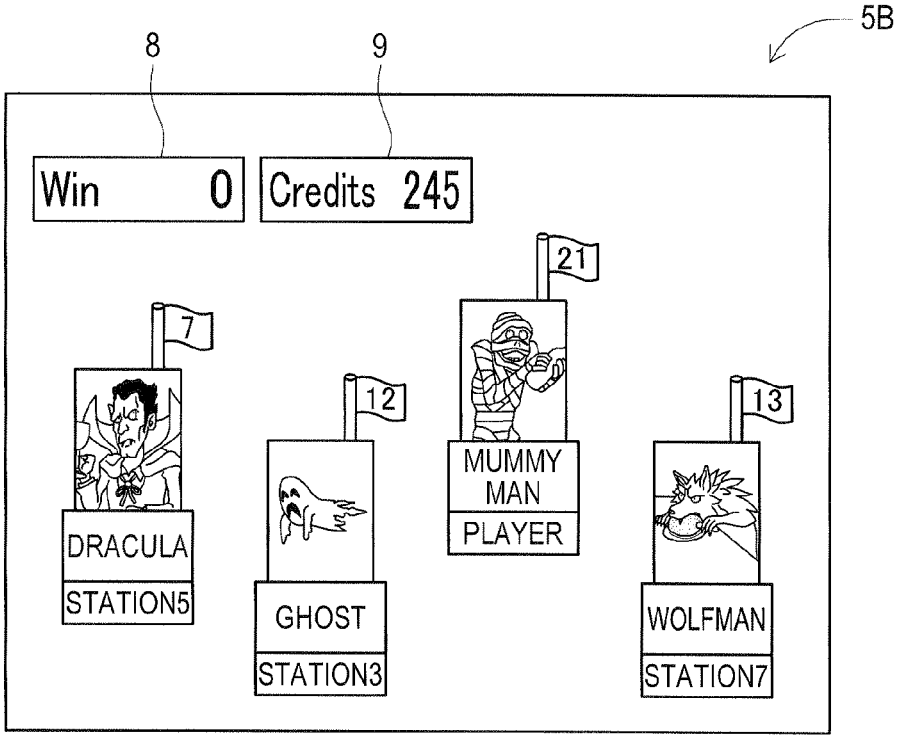
FIG. 12 is a view showing an image example displayed on the liquid crystal panel.

The matching screen as shown in FIG. 12 will be described below. According to the matching screen shown in FIG. 12, the preset character [Dracula] is displayed for the slot machine 1 whose identification number is [STATION 5] and the value of hit points of the [Dracula] is displayed in an ensign as [7].

The preset character [ghost] is displayed for the slot machine 1 whose identification number is [STATION 3] and the value of hit points of the [ghost] is displayed in an ensign as [12].

The preset character [mummy man] is displayed for the slot machine 1 whose identification number is [PLAYER] and the value of hit points of the [mummy man] is displayed in an ensign as [21]. The slot machine 1 is provided with the liquid crystal panel 5B displaying the matching screen shown in FIG. 12.

The preset character [wolfman] is displayed for the slot machine 1 whose identification number is [STATION 7] and the value of hit points of the [wolfman] is displayed in an ensign as [13].

Figure 13:
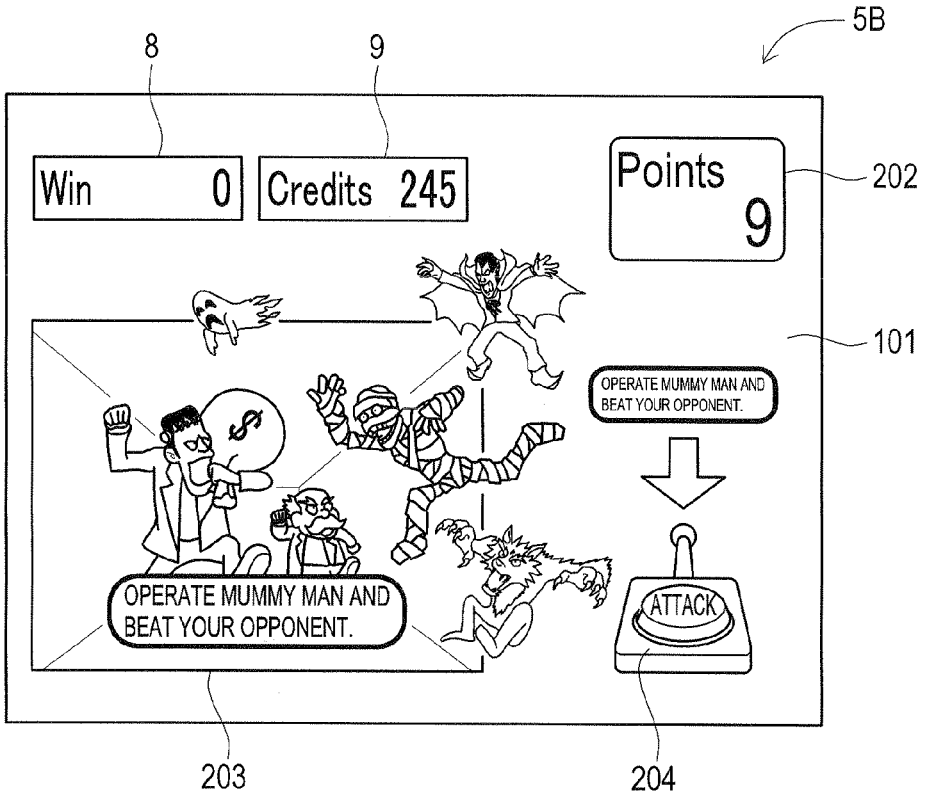
FIG. 13 is a view showing an image example displayed on the liquid crystal panel.

Then, the game server 302 produces a screen effect of the multi-player game by causing the liquid crystal panel 5B of each slot machine 1 participating in the multi-player game to display an operation screen as shown, for example, in FIG. 13. At this point, the player of each slot machine 1 participating in the multi-player game can execute the multi-player game by performing a game operation on the operation screen.

This point will be described using the operation screen shown in FIG. 13. The operation screen shown in FIG. 13 is provided with the point display portion 202, the game image 203 in which each character (such as Dracula, the ghost, the mummy man, and the wolfman), Frankenstein and the like are displayed, the attack button 204 and the like. Further, the operation screen shown in FIG. 13 has [OPERATE MUMMY MAN AND BEAT YOUR OPPONENT.] displayed thereon and the player of the slot machine 1 provided with the liquid crystal panel 5B displaying the operation screen shown in FIG. 13 performs a game operation to beat Frankenstein through operation of the mummy man by touching the attack button 204 via the touch panel 101.

At this point, a video of the mummy man dashing himself against Frankenstein is shown in the game image 203 inside the operation screen displayed on the liquid crystal panel 5B. Further, game operation information including data for notification of time points at which the player of the slot machine 1 touched the attack button 204 via the touch panel 101 and the like is transmitted from the slot machine 1 to the game server 302. However, the slot machine 1 slides the time points by a time duration in accordance with the value of hit points of the mummy man. The game server 302 determines a point amount counted as a degree of contribution based on the game operation information, the value of hit points of the mummy man and the like and returns game content information including data for notification of the determined point amount to the slot machine 1. In the slot machine 1, the point amount is added based on the game content information and displayed on the point display portion 202 inside the operation screen shown in FIG. 13.

The slot machine 1 whose identification number is [PLAYER] among the slot machines 1 introduced in the matching screen in FIG. 12 is applicable to the slot machine 1 in which such a multi-player game is executed because the [mummy man] is preset.

Regarding the slot machine 1 whose identification number is [STATION 5] among the slot machines 1 introduced in the matching screen in FIG. 12, if the player of the slot machine 1 performs a game operation to beat Frankenstein through operation of Dracula by touching the attack button 204 via the touch panel 101, a video in which Dracula sucking blood of Frankenstein is shown in the game image 203 inside the operation screen displayed on the liquid crystal panel 5B.

Regarding the slot machine 1 whose identification number is [STATION 3], if the player of the slot machine 1 performs a game operation to beat Frankenstein through operation of the ghost by touching the attack button 204 via the touch panel 101, a video in which the ghost scares Frankenstein is shown in the game image 203 inside the operation screen displayed on the liquid crystal panel 5B.

Regarding the slot machine 1 whose identification number is [STATION 7], if the player of the slot machine 1 performs a game operation to beat Frankenstein through operation of the wolfman by touching the attack button 204 via the touch panel 101, a video in which the wolfman bites Frankenstein is shown in the game image 203 inside the operation screen displayed on the liquid crystal panel 5B.

Then, in each slot machine 1 whose identification number is [STATION 5], [STATION 3], or [STATION 7], the multi-player game executes similarly and game operation information including data for notification of time points at which the player of the slot machine 1 touched the attack button 204 via the touch panel 101 and the like is transmitted from the slot machine 1 to the game server 302. However, each slot machine 1 slides the time points by a time duration in accordance with the value of hit points of the character. The game server 302 determines point amount counted as a degree of contribution based on the game operation information, the value of hit points of the character and the like and returns game content information including data for notification of the determined point amount to the slot machine 1. In the slot machine 1, the point amount is added based on the game content information and displayed on the point display portion 202 inside the operation screen displayed on the liquid crystal panel 5B.

In this manner, the game server 302 ends the multi-player game when the time is up by executing the multi-player game while counting a point amount for each slot machine 1. At this point, the game server 302 proportionally distributes the total amount of prizes acquired by all the slot machines 1 participating in the multi-player game in accordance with the point amount held by each slot machine 1.

Figure 14:
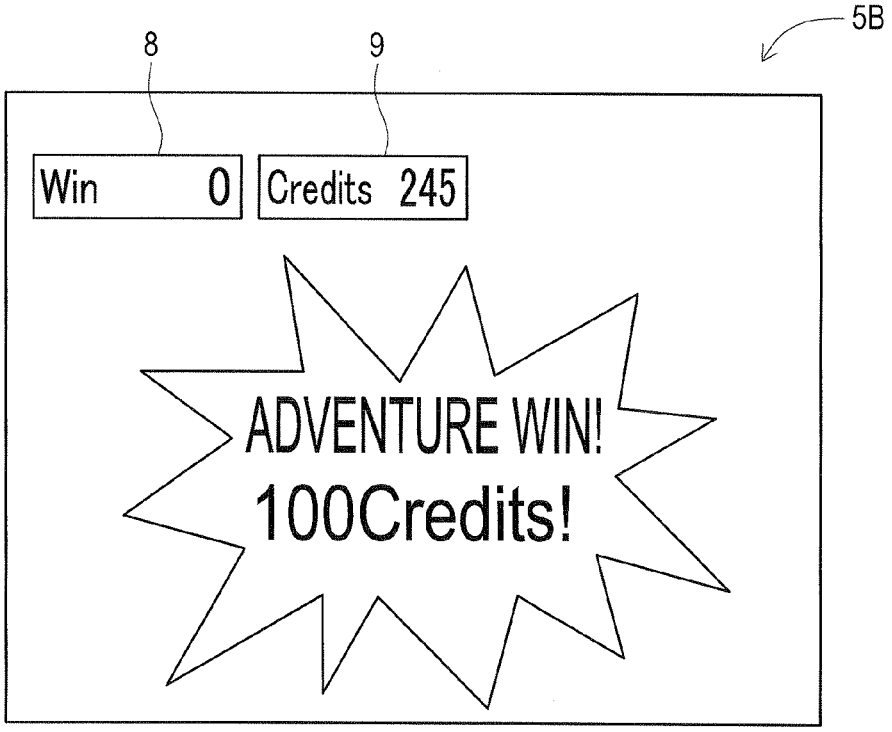
FIG. 14 is a view showing an image example displayed on the liquid crystal panel.

At this point, the game server 302 produces an effect of the scrambling game by causing the liquid crystal panel 5B of each slot machine 1 participating in the multi-player game to display a prize amount determination screen as shown, for example, in FIG. 14. In the prize amount determination screen as shown in FIG. 14, [ADVENTURE WIN! 100 Credits!] is displayed, showing that [100 Credits] of acquired prizes are distributed and awarded.

Further, the game server 302 randomly determines awarding of an extra prize to one of the slot machines 1 that participated in the multi-player game when the time of the multi-player game is up.

Figure 15:
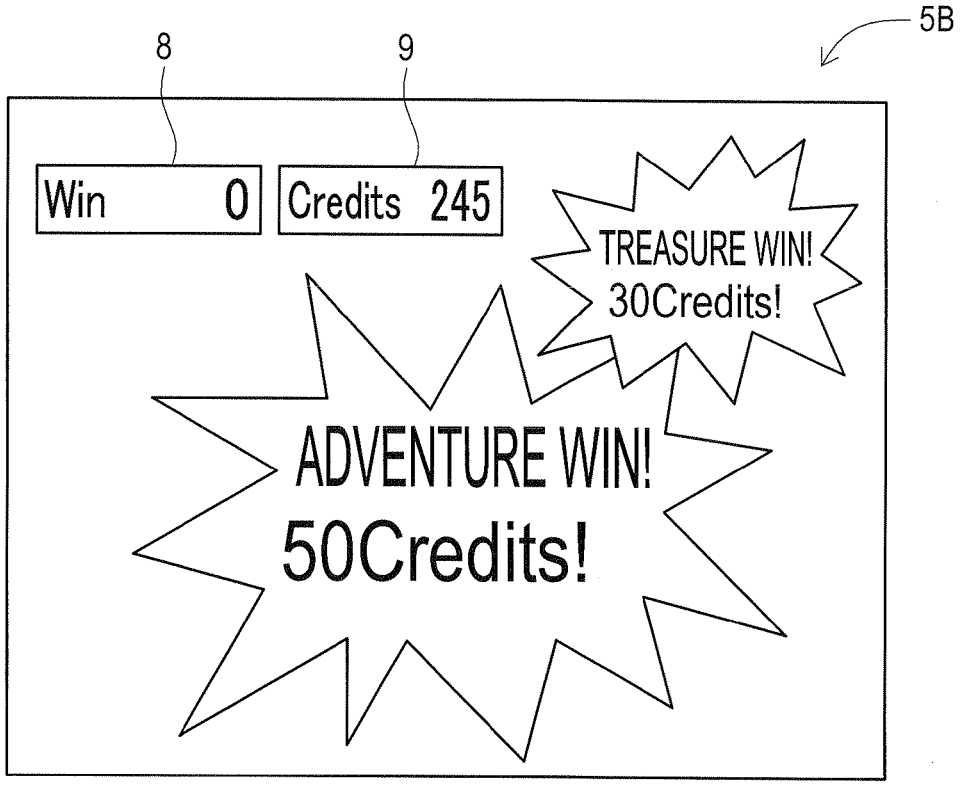
FIG. 15 is a view showing an image example displayed on the liquid crystal panel.

Then, the game server 302 produces an effect of the scrambling game by causing the liquid crystal panel 5B of the slot machine 1 determined to be awarded the extra prize to display a prize amount determination screen as shown, for example, in FIG. 15. In the prize amount determination screen shown in FIG. 15, [ADVENTURE WIN! 50 Credits!] is displayed and thus, [50 Credits] of acquired prizes are distributed and awarded. Further, [TREASURE WIN! 30 Credits!] is displayed and thus, [30 Credits] of the extra prize are awarded.

[8. Operation of Each Slot Machine]

Figure 16:
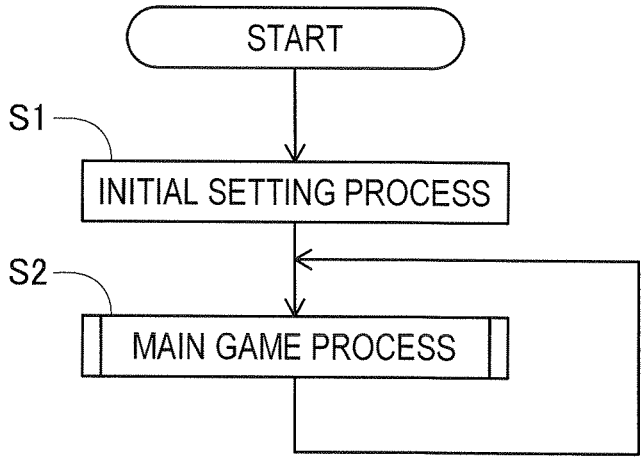
FIG. 16 is a flowchart of a main control program.

Next, a main control program executed in each slot machine 1 will be explained with reference to figures. FIG. 16 is a flowchart of the main control program.

First, when the power switch is pressed, the microcomputer 31 is started to operate, an initialization is executed by the microcomputer 31 in step (abbreviated as [S]) 1. In an initial setting process, the BIOS stored in the ROM 34 is executed by the main CPU 32. The compressed data included in the BIOS is expanded to the RAM 33, and when the BIOS expansion to the RAM 33 is executed, the diagnosing and initialization process of the various peripheral devices are executed. Also, the game programs and the like are written from the ROM 34 to the RAM 33 by the main CPU 32, so as to obtain the payout rate setting data and the country ID information. Also, during the execution of the initial setting process, the verification process to each program is executed.

And in S2, the main CPU 32 reads out the game programs and the like from the RAM 33, and executes the programs in sequence so as to execute a main game process. The game is executed in each slot machine 1 by executing the main game process. And the main game process is repeated in the slot machine 1 when the power is supplied to the slot machine 1.

Figure 17:
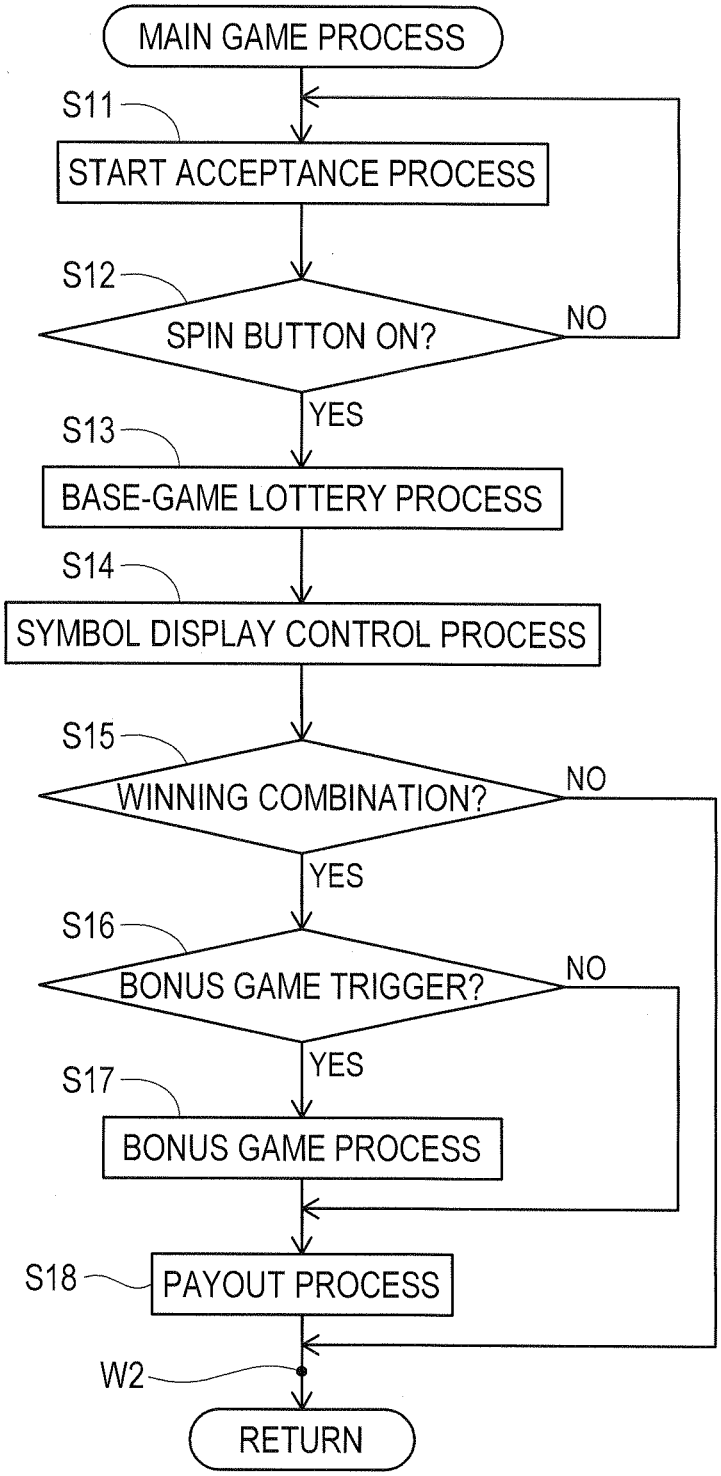
FIG. 17 is a flowchart of a main game process program.

Next, sub process of the main game process in S2 will be explained with reference to FIG. 17. FIG. 17 is a flowchart of the main game process program in each slot machine 1. Also, each program shown in the flowchart of FIG. 17 is stored in the ROM 34 or the RAM 33 of each slot machine 1, and is executed by the main CPU 32.

First, as shown in FIG. 17, a start acceptance process is executed by the main CPU 32 in S11. At this time, in the start acceptance process, the insertion of the coins or the bet operation using the BET button among the operation buttons 11 is executed by the player.

And then, it is determined by the main CPU 32 whether the spin button among the operation buttons 11 is pressed in S12. It is determined based on the input signals corresponding to the button pressing of the operation button 11 to the main CPU 32. Here, when the spin button among the operation buttons 11 is not pressed (S12: NO), the flow returns to the start acceptance process (S11) again. Thereby, it is possible to change the bet amount and the like. On the other hand, when the spin button among the operation buttons 11 is pressed (S12: YES), the bet amount set based on the above bet operation is reduced from the credit amount owned by the player at that time, and is stored in the RAM 33 as bet information. And the credit amount after reduction is also stored in the RAM 33 as credit information. And then, a control signal are transmitted to the display portion driving circuit 67 by the main CPU 32, the credits information stored in the RAM 33 (the above credit amount after reduction) is displayed on the credit display portion 9 of the liquid crystal panel 5B.

In S13, a base-game lottery process is executed by the main CPU 32. Concretely, when the lottery program included in the game programs is executed by the main CPU 32, the random number corresponding to each video reel R1, R2 and R3 respectively is selected from a range of [0] to [255]. And with reference to the symbol weighing data corresponding to the payout rate setting data, based on the three random numbers, the code numbers of the respective video reels R1, R2 and R3 is determined. The determined code numbers of the respective video reels R1, R2 and R3 is stored in the RAM 33 by the main CPU 32, and the flow proceeds to S14.

Here, the code numbers of the respective video reels R1, R2 and R3 are associated with the symbol numbers (symbol numbers shown in FIG. 4) of the symbols which are rearranged on the pay line L of the liquid crystal panel 5B. The main CPU 32 determines the symbol combination in the unit game by determining the code numbers of the respective video reels R1, R2 and R3. For instance, if the symbol numbers of the respective video reels R1, R2 and R3 are set to [21], [21] and [21], the main CPU 32 decides for a symbol combination made up of three [FRANKENSTEIN] symbols (refer to FIG. 4), as the symbol combination in the unit game. Lottery for the symbol combination in the unit game of the slot game is carried out by determining the code numbers of the respective video reels R1, R2 and R3.

When the flow proceeds to S14, a symbol display control process is executed by the main CPU 32. Concretely, first, a reel rotation process is executed by the main CPU 32. In other words, a control signal is transmitted to the sub control board 72 by the main CPU 32, so as to display each video reel R1, R2, and R3 in a rotating manner on each window W1, W2 and W3 of the liquid crystal panel 5B. And then, the effect mode (the display mode of the images on the liquid crystal panel 5B and the sound output mode from the speaker 23) is determined by the main CPU 32, and the sub control board 72 is ordered to start the effect in a predetermined effect pattern.

And then, when the predetermined stop timing to display each video reel R1, R2, and R3 in a rotating manner comes, a reel stop process is executed by the main CPU 32 which transmits control s signal to the sub control board 72. Thereby each video reel R1, R2, and R3 is displayed in a stopping manner, based on the code numbers stored in the RAM 33. Thereby, the symbol combination determined in above S13 is rearranged on the pay line L of the liquid crystal panel 5B.

Figures 18, 19:
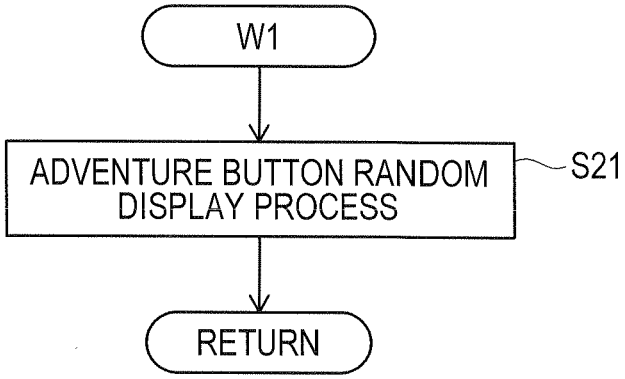
FIG. 18 is a flowchart of the main game process program.
FIG. 19 is a table showing correspondence relationships between an adventure button and a random number value.

After executing the symbol display control process in above S14, the main CPU 32 executes a process in S21 shown in FIG. 18. Thus, the process in S21 will be described based on FIG. 18. Incidentally, a program shown by S21 in FIG. 18 is stored in the ROM 34 or the RAM 33 provided to the slot machine 1, and executed by the main CPU 32.

In S21, the main CPU 32 executes an adventure button random display process. During the adventure button random display process, the main CPU 32 randomly selects one random number from the numeric range of [0] to [255]. Then, the main CPU 32 refers to a table shown in FIG. 19 to determine whether or not to cause the liquid crystal panel 5B to display the adventure button 201 based on the selected random number.

The table shown in FIG. 19 is stored in the ROM 34 or the RAM 33 provided to the slot machine 1 and referred to by the main CPU 32. The table shown in FIG. 19 will be described. If the selected random number is in the range of [0] to [250], the main CPU 32 determines not to cause the liquid crystal panel 5B to display ([X]) the adventure button 201 and if the selected random number is in the range of [251] to [255], the main CPU 32 determines to cause the liquid crystal panel 5B to display ([O]) the adventure button 201.

Therefore, if the main CPU 32 selects a random number in the range of [0] to [250], the main CPU 32 determines not to cause the liquid crystal panel 5B to display the adventure button 201 and returns to the main game process in above FIG. 17. If, on the other hand, the main CPU 32 selects a random number in the range of [251] to [255], the main CPU 32 determines to cause the liquid crystal panel 5B to display the adventure button 201. Then, the main CPU 32 returns to the main game process in above FIG. 17. Incidentally, while the adventure button 201 is displayed on the liquid crystal panel 5B, even if a random number in the range of [251] to [255] is selected, the main CPU 32 returns to the main game process in above FIG. 17 without doing anything.

Then, returning to the main game process of above FIG. 17, the main CPU 32 proceeds to S15, at which it determines whether or not a winning combination has been realized. This determination is made based on the code numbers of the respective video reels R1, R2 and R3 that were stored in the RAM 33. If a winning combination has not been realized (S15: NO), the flow proceeds to S31 in FIG. 20 as described below. Alternatively, if a winning combination has been realized (S15: YES), the flow proceeds to S16.

Also, in S15, the main CPU 32 executes a payout amount display process. More specifically, first, the main CPU 32 calculates an amount obtained by multiplying the payout amount in accordance with the winning combination rearranged on the pay line L of the liquid crystal panel 5B, with the bet amount. This calculation is made based on the bet information stored in the RAM 33 and the payout table in FIG. 7, the calculated amount is stored in the RAM 33 as payout information. Then, the main CPU 32 displays the payout information (calculated amount) stored in the RAM 33 on the payout amount display portion 8 of the liquid crystal panel 5B, by transmitting a control signal to the display portion driving circuit 67.

Then, the main CPU 32 proceeds to S16, at which it judges whether or not the bonus game trigger is realized. More specifically, if three [FRANKENSTEIN] symbols are rearranged on the pay line L of the liquid crystal panel 5B, it is determined that the bonus game trigger is realized. This determination as well is carried out based on the code numbers of the respective video reels R1, R2 and R3 stored in the RAM 33. If the bonus game trigger is realized (S16: YES), the main CPU 32 executes a bonus game process in S17. Additionally, the slot game is automatically repeated up to the predetermined number of times in the bonus game process, and details thereof are omitted.

After that, the main CPU 32 executes a payout process is S18, including the case when the bonus game trigger is not realized (S16: NO). In the payout process, the payout amount obtained by the player during the slot game and the bonus game (the free game), is awarded to the player respectively, based on the payout information stored in the RAM 33.

When the payout is executed, the credit amount which are stored in the RAM 33 as the payout information (the payout amount obtained by the player in the base game and the bonus game (the free game) respectively) are added to the credit amount stored in the RAM 33 as the credit information by the main CPU 32, and the added value is overwritten in the RAM 33 as the credit information by the main CPU 32. And then, a control signal are transmitted to the display portion driving circuit 67 by the main CPU 32, the credits information stored in the RAM 33 (the added value in S18) is displayed on the credit display portion 9 of the liquid crystal panel 5B. At the same time, [0] is overwritten to the RAM 33 as the payout information by the main CPU 32, and by transmitting a control signal to the display portion driving circuit 67, on the payout amount display portion 8 of the liquid crystal panel 5B, [0] is displayed.

In this payout process, when the player depresses the CASHOUT button among the operation buttons 11, the credit amount which is owned by the current player can be paid out in coins, corresponding to that amount (1 credit corresponding to 1 coin). Alternatively, the credit amount can be paid out through barcode-attached tickets which are printed in the ticket printer 14. Then, after the main CPU 32 executed the payout process in the above S18, the flow proceeds to S31 in FIG. 20 as described below.

[9. Operation of the Gaming System]

Figure 20:
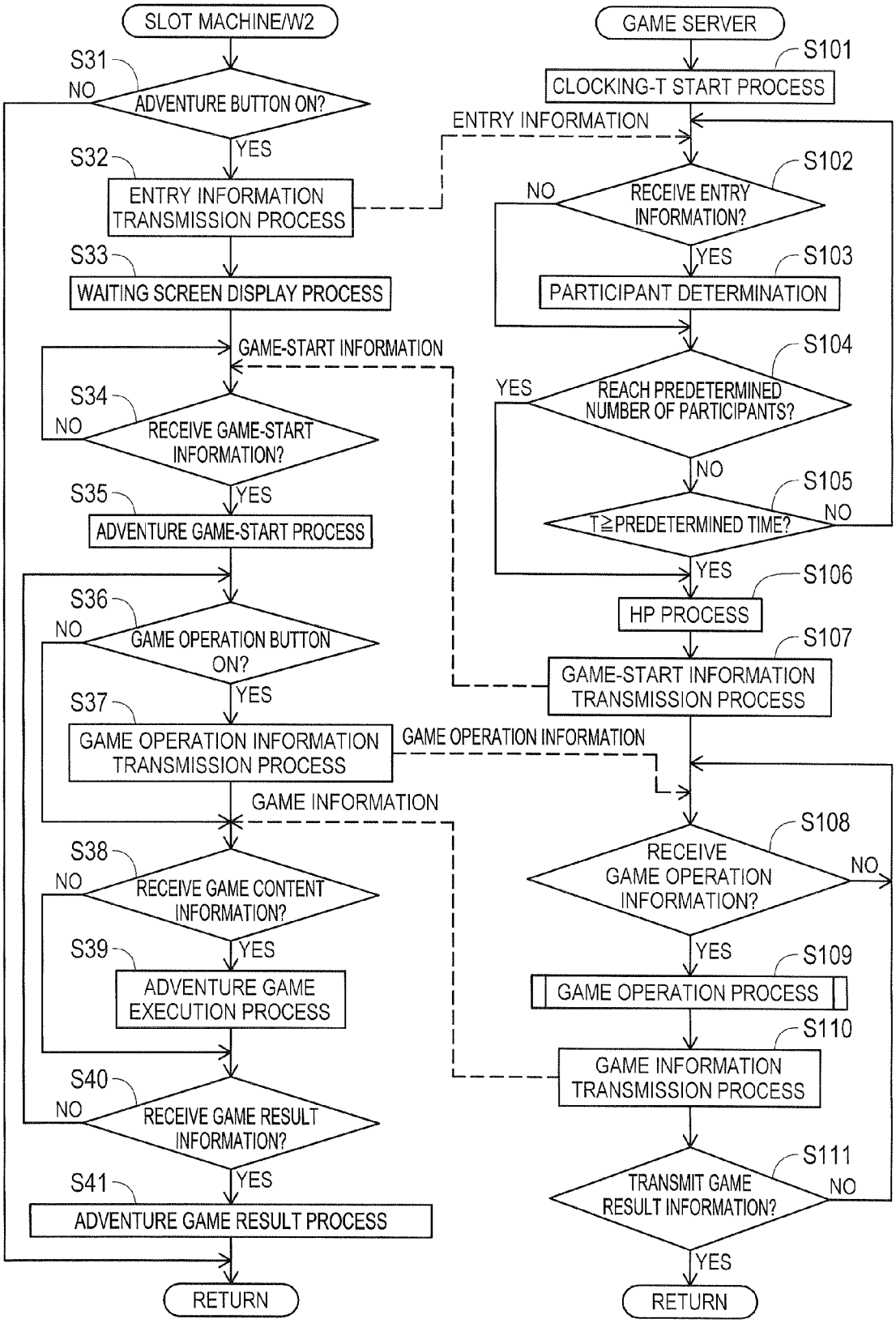
FIG. 20 is a flowchart of a control program executed in between each gaming machine and a game server.

After executing the payout process in S18, the main CPU 32 executes each process of S31 to S41 shown in FIG. 20. Thus, each process of S31 to S41 will be described based on FIG. 20. Each program shown by S31 to S41 in FIG. 20 is stored in the ROM 34 or the RAM 33 of each slot machine 1 and executed by the main CPU 32.

If the main CPU 32 determines that there is no winning combination in S15 (S15: NO), the main CPU 32 executes the payout process in S18 and then proceeds to S31 shown in FIG. 20.

In S31, the main CPU 32 determines whether or not a player has touched the adventure button 201, which is an entry button. This determination is based on a signal or the like input into the main CPU 32 from the touch panel 101 in accordance with the adventure button 201 being touched. Here, if the player has not touched the adventure button 201 (S31: NO), the main CPU 32 executes the main game process shown in FIG. 17 again. If, on the other hand, the player has touched the adventure button 201 (S31: YES), the main CPU 32 proceeds to S32.

In S32, the main CPU 32 executes an entry information transmission process. During the entry information transmission process, the main CPU 32 transmits entry information including data for notification of participation of the slot machine 1 in a multi-player game to the game server 302 via the game communication circuit 102.

Figure 11:
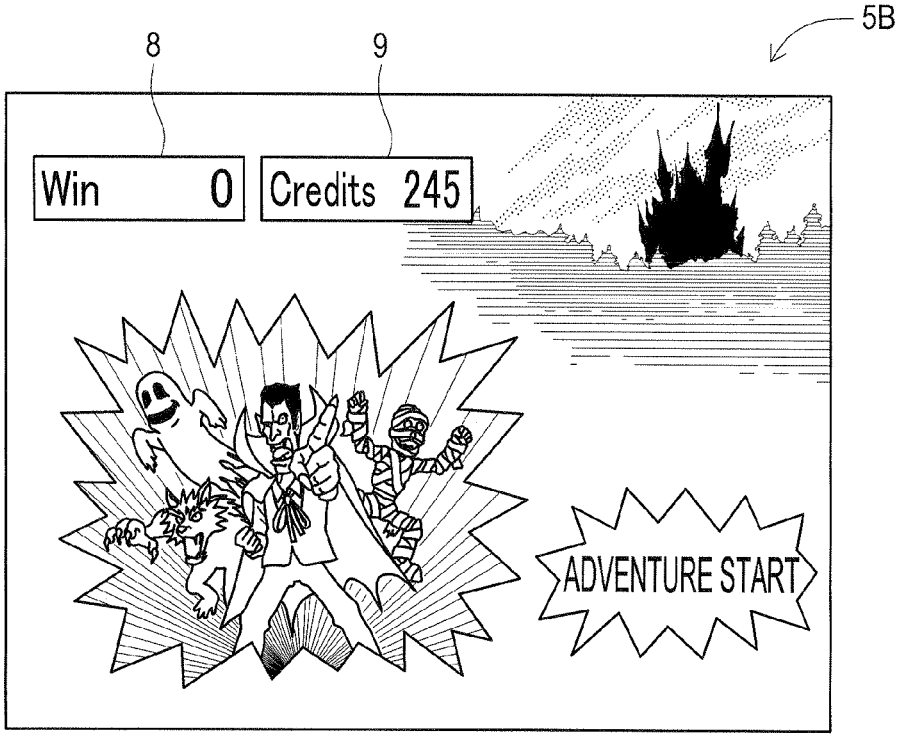
FIG. 11 is a view showing an image example displayed on the liquid crystal panel.

In S33, the main CPU 32 executes a waiting screen display process. During the waiting screen display process, the main CPU 32 causes the liquid crystal panel 5B to display a waiting screen by transmitting a control signal to the sub control board 72. The waiting screen is an effect screen indicating to the player that a multi-player game has started and, for example, the entry screen shown in FIG. 11 is made to be displayed as an effect screen thereof. Then, the main CPU 32 proceeds to S34.

In S34, the main CPU 32 determines whether or not game-start information has been received from the game server 302. This determination is based on a signal or the like input into the main CPU 32 from the game communication circuit 102 in accordance with game-start information being received from the game server 302. Here, the main CPU 32 waits (S34: NO) until game-start information is received from the game server 302 and when game-start information is received from the game server 302 (S34: YES), the main CPU 32 proceeds to S35.

In S35, the main CPU 32 executes an adventure game-start process. During the adventure game-start process, the main CPU 32 causes the liquid crystal panel 5B to display a matching screen by transmitting a control signal to a sub control board 72 based on game-start information received from the game server 302. The matching screen is a screen, as shown, for example, in FIG. 12, to introduce each slot machine 1 participating in a multi-player game, the character preset to each slot machine 1, and the value of hit points of each of such characters.

Further, after a predetermined time period passes, the main CPU 32 causes the liquid crystal panel 5B to display an operation screen, instead of the matching screen, by transmitting a control signal to the sub control board 72 based on the game-start information received from the game server 302. The operation screen is a screen, as shown, for example, in FIG. 13, to execute the multi-player game by a game operation of the player. Then, the main CPU 32 proceeds to S36.

In S36, the main CPU 32 determines whether or not the player has touched the attack button 204, which is a game operation button. This determination is based on a signal input from the touch panel 101 into the main CPU 32 in accordance with the attack button 204 being touched. Here, if the player has not touched the attack button 204 (S36: NO), the main CPU 32 proceeds to S38 described below.

If, on the other hand, the player has touched the attack button 204 (S36: YES), the main CPU 32 proceeds to S37. At this point, the main CPU 32 shows a video in which the character preset to the slot machine 1 attacks Frankenstein in the game image 203 inside the operation screen on the liquid crystal panel 5B, by transmitting a control signal to the sub control board 72.

In S37, the main CPU 32 executes a game operation information transmission process. During the game operation information transmission process, the main CPU 32 first identifies a time point at which the player of the slot machine 1 touched the attack button 204 based on a signal input from the touch panel 101 into the main CPU 32 in accordance with the attack button 204 on the operation screen of the liquid crystal panel 5B being touched by the player. Then, the main CPU 32 determines the time duration based on the value of hit points included in the game-start information and slides the time point by the time duration. Then, the main CPU 32 transmits game operation information including data for notification of the (slid) time point at which the player of the slot machine 1 touched the attack button 204 to the game server 302 via a game communication circuit 102. Then, the main CPU 32 proceeds to S38.

In S38, the main CPU 32 determines whether or not game content information has been received from the game server 302. This determination is based on a signal input from the game communication circuit 102 into the main CPU 32 in accordance with game content information being received from the game server 302 or the like. Here, if no game content information has been received from the game server 302 (S38: NO), the main CPU 32 proceeds to S40 described below. If, on the other hand, game content information has been received from the game server 302 (S38: YES), the main CPU 32 proceeds to S39.

In S39, the main CPU 32 executes an adventure game execution process. During the adventure game execution process, the main CPU 32 adds the point amount included in the game content information received from the game server 302 to the value stored in point information of the RAM 33 and then transmits a control signal to the sub control board 72 to cause the point display portion 202 inside the operation screen on the liquid crystal panel 5B to display the added value. Then, the main CPU 32 proceeds to S40.

In S40, the main CPU 32 determines whether or not game result information has been received from the game server 302. This determination is based on a signal input from the game communication circuit 102 into the main CPU 32 in accordance with game result information being received from the game server 302 or the like. Here, if no game result information has been received from the game server 302 (S40: NO), the main CPU 32 returns to above S36 to repeat the processes in above S36 and thereafter. If, on the other hand, game result information has been received from the game server 302 (S40: YES), the main CPU 32 proceeds to S41.

In S41, the main CPU 32 executes an adventure game result process. During the adventure game result process, the main CPU 32 first causes the liquid crystal panel 5B to display a prize amount determination screen as shown, for example, in FIG. 14 or FIG. 15 by transmitting a control signal to the sub control board 72 based on the game result information received from the game server 302.

Here, if the game result information received from the game server 302 includes data for notification of awarding of only a credit amount corresponding to an amount obtained by proportionally distributing the total amount of acquired prizes, the main CPU 32 causes the liquid crystal panel 5B to display the prize amount determination screen as shown, for example, in FIG. 14 by transmitting a control signal to the sub control board 72 based on the game result information received from the game server 302. The prize amount determination screen is a message screen showing that a credit amount corresponding to an amount proportionally distributed in accordance with the point amount held by the slot machine 1 of the total amount of prizes acquired by all the slot machines 1 participating in the multi-player game has been awarded.

If, on the other hand, the game result information received from the game server 302 includes data for notification of awarding of a credit amount corresponding to an amount of the extra prize, in addition to a credit amount corresponding to an amount obtained by proportionally distributing the total amount of acquired prizes, the main CPU 32 causes the liquid crystal panel 5B to display the prize amount determination screen as shown, for example, in FIG. 15 by transmitting a control signal to the sub control board 72 based on the game result information received from the game server 302. The prize amount determination screen is a message screen showing that, in addition to a credit amount corresponding to an amount proportionally distributed in accordance with the point amount held by the slot machine 1 of the total amount of prizes acquired by all the slot machines 1 participating in the multi-player game, a credit amount corresponding to an amount of the extra prize has been awarded.

Further, after causing the liquid crystal panel 5B to display the prize amount determination screen, the main CPU 32 adds a credit amount included in the game result information received from the game server 302 to the credit amount stored in the RAM 33 as credit information and then overwrites the RAM 33 with the added value as credit information. Then, the main CPU 32 causes the credit amount display portion 9 of the liquid crystal panel 5B to display the credit information (the added value determined here) stored in the RAM 33 by transmitting a control signal to the display portion driving circuit 67. Then, after a predetermined time period passes, the main CPU 32 causes the liquid crystal panel 5B to display a screen of slot game as shown in FIG. 8 by transmitting a control signal to the sub control board 72. Then, the main CPU 32 executes the main game process in FIG. 17 again.

In the game server 302, on the other hand, each process of S101 to S111 shown in FIG. 20 is executed. Thus, each process of S101 to S111 will be described based on FIG. 20. Each program shown by S101 to S11 in FIG. 20 is stored in the game server 302 and executed by the game server 302.

The game server 302 first executes a clocking-T start process in S101. During the clocking-T start process, the game server 302 starts clocking of a time T. Then, the game server 302 proceeds to S102.

In S102, the game server 302 determines whether or not entry information has been received from one of the slot machines 1 connected thereto via the network 401. This determination is based on a signal or the like output from the server communication circuit 303 in accordance with entry information being received. Here, if no entry information has been received (S102: NO), the game server 302 proceeds to below S104. If, on the other hand, entry information has been received (S102: YES), the game server 302 proceeds to S103.

In S103, the game server 302 executes a participant determination process. During the participant determination process, the game server 302 stores the slot machine 1 that has transmitted entry information as a participant of the multi-player game. Then, the game server 302 proceeds to S104.

In S104, the game server 302 determines whether or not the number of slot machines 1 stored as participants of the multi-player game has reached a predetermined number. The predetermined number is preset and may be a constant of one or greater. Here, if the number of slot machines 1 has reached the predetermined number (S104: YES), the game server 302 proceeds to S106 described below. If, on the other hand, the number of slot machines 1 has not reached the predetermined number (S104: NO), the game server 302 proceeds to S105.

In S105, the game server 302 determines whether or not a first predetermined time period has passed. This determination is based on the time T at which clocking was started in above S101. Here, if the first predetermined time period has not passed (S105: NO), the game server 302 returns to above S102 to repeat processes in above S102 and thereafter. If, on the other hand, the first predetermined time period has passed (S105: YES), the game server 302 proceeds to S106.

In S106, the game server 302 executes a HP process. During the HP process, the game server 302 randomly determines the value of hit points of the character preset to the slot machine 1 for each slot machine 1 that has transmitted entry information. At this point, if the number of the slot machines 1 stored as participants in above S103 does not reach the predetermined number in above S104, the game server 302 adds itself as a participant and randomly determines the value of hit points of the character preset to the game server 302 after each addition until the predetermined number is reached.

Then, the game server 302 proceeds to S107 to execute a game-start information transmission process. During the game-start information transmission process, the game server 302 creates a matching screen, which looks like, for example, FIG. 12, to introduce the slot machines 1 stored as participants of the multi-player game in S103 or the like. Then the game server 302 returns as game start information a control signal for causing the liquid crystal panel 5B to display the matching screen to each slot machine 1 that has transmitted entry information. The game start information includes data for notification of the character preset to each slot machine 1 as a participant of the multi-player game, the value of hit points of the character determined in S106 and the like (refer to FIG. 12).

Further, the game server 302 creates an operation screen, which looks like, for example, FIG. 13 so as to execute the multi-player game by game operations of players and enters a control signal to cause the liquid crystal panel 5B to display the operation screen instead of the matching screen in the game start information.

Then, the game server 302 proceeds to S108 to determine whether game operation information has been received from one of the slot machines 1 that has transmitted entry information. This determination is based on a signal output from a server communication circuit 303 in accordance with game operation information being received or the like. Here, the game server 302 waits (S108: NO) until game operation information is received from one of the slot machines 1 and when game operation information is received from one of the slot machines 1 (S108: YES), proceeds to S109.

In S109, the game server 302 executes a game operation process. During the game operation process, the game server 302 executes processes of S121 to S126 shown in FIG. 21. Thus, each process of S121 to S126 will be described based on FIG. 21. Each program shown by S121 to S126 in FIG. 21 is stored in the game server 302, and executed by the game server 302.

Figure 21:
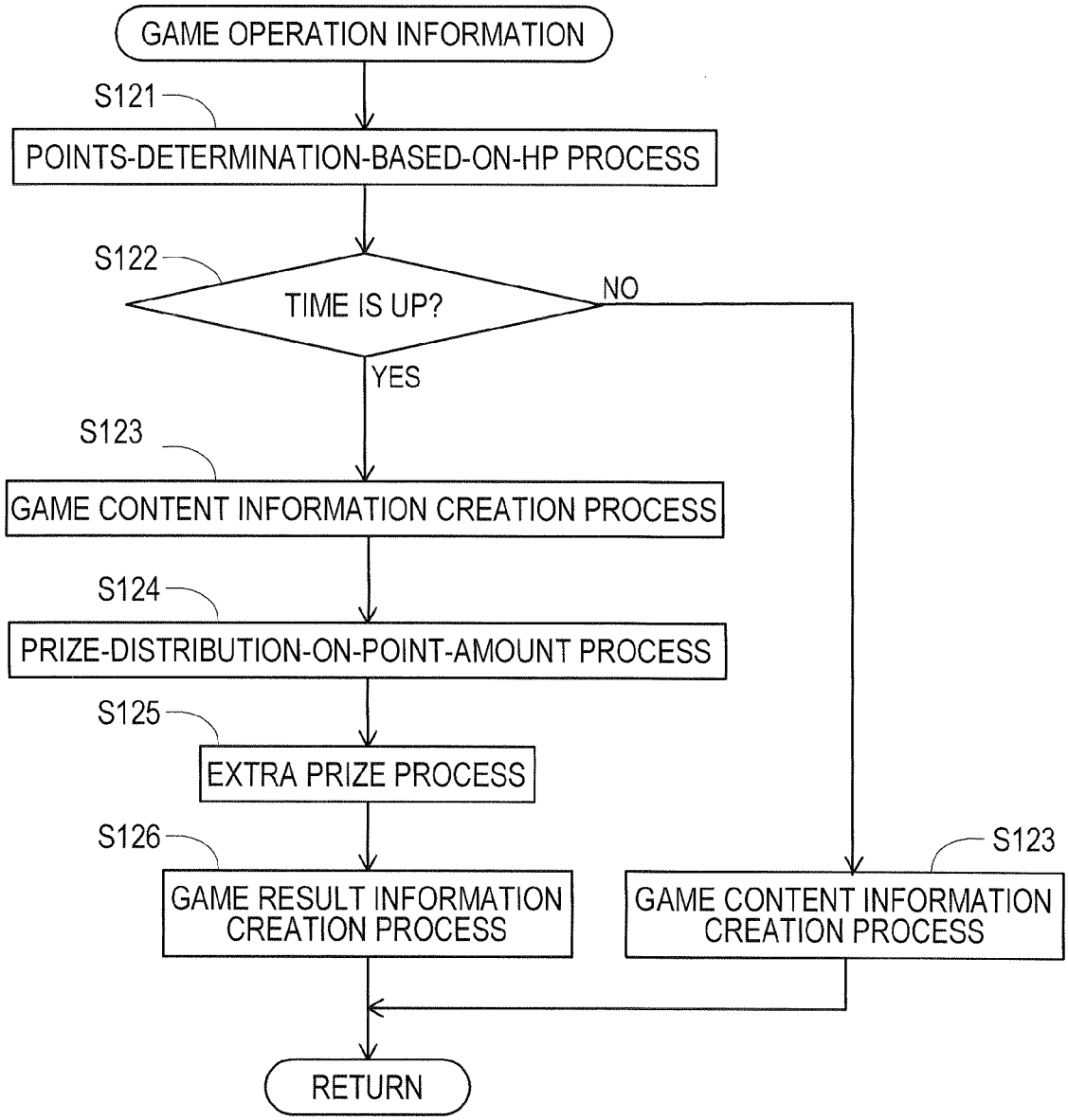
FIG. 21 is a flowchart of a control program executed in between each gaming machine and the game server.

To execute the game operation process in S109, the game server 302 first proceeds to S121 shown in FIG. 21. In S121, the game server 302 executes a points-determination-based-on-HP process. During the process, the game server 302 determines a point amount based on game operation information transmitted from one of the slot machines 1 that has transmitted entry information, the value of hit points determined in above S106 for the character preset to the slot machine 1 and the like. Further, the game server 302 manages the point amount determined as described above by adding for each slot machine 1 participating in the multi-player game. Then, the game server 302 proceeds to S122.

In S122, the game server 302 determines whether or not the time of the multi-player game is up. This determination is based on, for example, a time T at which clocking was started in above S101. Naturally, this determination is not limited thereto and may be made, for example, based on a time at which clocking was started after the game-start information transmission process has been started in above S107. Here, if the time of the multi-player game is not up (S122: NO), the game server 302 proceeds to S123.

In S123, the game server 302 executes a game content information creation process. In the game content information creation process, the game server 302 returns game content information including data for notification of the point amount determined in S121 to each slot machine 1 that has transmitted entry information as game information. Then, the game server 302 proceeds to S110 in above FIG. 20.

If, on the other hand, the time of the multi-player game is up in above S122 (S122: YES), the game server 302 proceeds to S124 to execute a prize-distribution-on-point-amount process. During the process, the game server 302 determines the amount of acquired prize to be awarded to each slot machine 1 by proportionately distributing the total amount of prizes acquired by all the slot machines 1 that participated in the multi-player game in accordance with the point amount held by each slot machine 1. Then, the game server 302 proceeds to S125.

In S125, the game server 302 executes an extra prize process. During the extra prize process, the game server 302 randomly identifies one slot machine 1 of all the slot machines 1 that participated in the multi-player game. Then, the game server 302 proceeds to S126.

In S126, the game server 302 executes a game result information creation process. During the game result information creation process, the game server 302 creates game result information including data for notification of an end of the multi-player game and awarding of a credit amount corresponding to an amount of the acquired prize proportionately distributed in above S124 for each slot machine 1 that has transmitted entry information and returns the game result information as game information. The game server 302 enters data for notification of awarding of a credit amount corresponding to the extra prize in the game result information to be transmitted to the slot machine 1 identified in above S125. Then, the game server 302 proceeds to S110 in above FIG. 20.

Then, after executing the process in above S123 or that in above S126, the game server 302 proceeds to S110 in above FIG. 20.

Returning to above FIG. 20, in S110, the game server 302 executes a game information transmission process. During the game information transmission process, the game server 302 returns the game content information created in S123 of above FIG. 21 or the game result information created in S126 of above FIG. 21 to each slot machine 1 that has transmitted entry information as game information. Then, the game server proceeds to S111.

In S111, the game server 302 determines whether or not the game information transmitted in above S110 is game result information. This determination is based on a transmission result in above S110. Here, if the game information is not game result information (S111: NO), the game server 302 returns to above S108 to repeat processes in above S108 and thereafter. If, on the other hand, the game information is game result information (S111: YES), the game server 302 returns to the main program of the game server 302 and returns to above S101.

[10. Summary]

In the gaming system 301 according to the present embodiment, as described above in detail, the player of each slot machine 1 can participate in a multi-player game operated by the game server 302 by touching the adventure button 201 randomly displayed on the liquid crystal panel 5B via the touch panel 101 on condition that the total amount of acquired prizes be proportionally distributed among all participants according to the degree of contribution of each participant (S31: YES).

Then, the operation screen (refer to FIG. 13) is displayed on the liquid crystal panel 5B of each slot machine 1 participating in the multi-player game (S35) and the player of each slot machine 1 executes the multi-player game through operation of the character preset to the slot machine 1 among characters displayed in the game image 203 on the operation screen of the liquid crystal panel 5B by touching the attack button 204 on the operation screen of the liquid crystal panel 5B via the touch panel 101 (S36: YES, S37).

At this point, the game server 302 acquires time points at which the attack button 204 was operated and determines a point amount based on the time points and the like (S109, S121). Points determined in this manner are added for each slot machine 1 participating in the multi-player game, managed by the game server 302, and displayed on the point display portion 202 on the operation screen of the liquid crystal panel 5B for each slot machine 1 (S39).

Then, when the time of the multi-player game is up (S109, S122: YES), the total amount of prizes acquired by all participants is proportionally distributed to each slot machine 1 based on the point amount of each slot machine 1 (S109, S124) and a credit amount corresponding to the proportionally distributed prize amount is awarded to the slot machine 1 (S41).

Therefore, the credit amount awarded to each slot machine 1 that has participated in the multi-player game is affected by the size relation of the point amount held by each slot machine 1. Consequently, game operation information used for determining the point amount, that is, time points at which the player operates the attack button 204 on the operation screen of the liquid crystal panel 5B become important. However, the game server 302 further refers to the value of hit points randomly determined for the character preset to the slot machine 1 (S106) to determine the point amount to the slot machine 1 (S109, S121).

[11. Others]

The present invention is not limited to the above embodiment and can be modified in various ways without deviating from the scope thereof.

For example, the matching screen in FIG. 12 and the operation screen in FIG. 13 may be created by each slot machine 1.

Each character used in a multi-player game may be randomly allocated to each slot machine 1 when the multi-player game is started.

The total amount of prizes acquired by all participants of a multi-player game may be constant at all times, changed in accordance with time points and the like at which players operated the attack button 204 on the operation screen of the liquid crystal panel 5B, or determined randomly by the game server 302. This applies also to the amount of the extra prize in a multi-player game.

Further, the extra prize may be awarded to two or more the slot machines 1 at the same time.

One of the slot machines 1 connected to the network 401 may be caused to function as the game server 302.

What is claimed is:

1. A gaming system comprising:

a game server; and a plurality of slot machines which are connected to the game server and configured to execute a slot game and a multiplayer game;

wherein the game server includes a server communication circuit allowing a bidirectional communication among the game server and the plurality of slot machines, the game server randomly notifying a participation chance in a multi-player game of slot machines and giving the multi-player game to each slot machine which transmits to the game server a notification of participation in the multi-player game, wherein the multi-player game is progressed by stages comprising:

(A) assigning a random value of hit points to a character preset to each slot machine which has transmitted to the game sever the notification of participation in the multi-player game, before start of the multi-player game;

(B) operating the character at each slot machine so as to acquire points by competing with an other character operated at an other slot machine participating in the multi-player game, the acquired points being determined based on the hit points;

(C) at an end of the multi-player game, dividing and distributing a total amount of prize set for the multi-player game to all slot machines which have participated in the multi-player game proportionally according to a total value of the points each slot machine has acquired during the multi-player game; and (D) converting an amount of prize proportionally distributed to each slot machine from the total amount of prize to a corresponding value of credits and adding the corresponding value of credits to credits the slot machine currently holds, wherein each of the plurality of slot machines includes:

a CPU which controls execution of the slot game progressed independently at each slot machine;

a display panel which displays plural video reels during the slot game, and erases the plural video reels and displays characters during the multi-player game;

an input device which is indicated in the display panel together with the plural video reels during the slot game so as to notify the participation chance in the multi-player game and allow each slot machine to input and transmit the notification of participation in the multi-player game to the game server; and at least one slot configured to receive gaming media for providing credits to be bet and to add the credits to a credit amount display portion for each slot machine;

a bet-placing mechanism by which a player can bet an amount of credits based on the credit amount display portion; and a pay-out mechanism by which credits can be paid out to the player or credited to the credit amount display portion under control of the CPU as an outcome of the slot game or the multi-player game, wherein, between the game server and the CPU of each of the plurality of slot machines, there are programmed to execute, as a result of the player having bet game media, process steps comprising:

(i) determining to execute the multi-player game;

(ii) allowing the display panel of each slot machine individually executing the slot game to indicate the participation chance in the multi-player game while the display panel displays the plural video reels for the slot game;

(iii) allowing the display panel to keep displaying the plural video reels so as to allow at least one slot machine to continue the slot game individually when the at least one slot machine individually executing the slot game withholds an input of a transmission of the notification of participation in the multi-player game by using the input device, and allowing the display panel to erase the plural video reels and display the characters preset to respective two or more slot machines for the multi-player game when the two or more slot machines individually executing the slot game make an input of a transmission of the notification of participation in the multi-player game by using the input device;

(iv) assigning the random value of the hit points to each of the characters preset to the respective two or more slot machines, when the two or more slot machines individually executing the slot game make the input of the transmission of the notification of participation in the multi-player game by using the input device at the step of (iii), (v) counting the points each of the characters has acquired as a result of operation of each of the characters during the multi-player game, the acquired points of each of the characters being determined based on the hit points randomly assigned to each of the characters at the step of (iv);

(vi) allowing the display panel to indicate the points of each slot machine counted at the step of (v); and (vii) determining distribution proportion of the total amount of prize according to a value of points of each slot machine counted at the step of (v), converting the amount of prize proportionally distributed to each slot machine from the total amount of prize to the corresponding value of credits and adding the corresponding value of credits to the credits each slot machine currently holds.

2. The gaming system according to claim 1, wherein the step of (vii) further includes a step of randomly determining a slot machine to win an extra prize by lottery, converting an amount of the extra prize to a corresponding value of credits and adding the corresponding value of credits to credits the slot machine winning the extra prize currently holds.

3. The gaming system according to claim 1, wherein, during processing of the steps (i) to (iiv) between the game server and the CPU of each of the plurality of slot machines, each slot machine participating in the multi-player game is configured to indicate in the display panel a matching screen which introduces following information pieces (a) through (c):

(a) all of slot machines participating in the multi-player game;

(b) the characters preset to all of the slot machines participating in the multi-player game; and (c) the random value of hit points assigned to each of the characters preset to all of the slot machines participating in the multi-player game.

* * * * *